US007857314B2

(12) United States Patent
Scibetta

(10) Patent No.: US 7,857,314 B2
(45) **Date of Patent: *Dec. 28, 2010**

(54) SYSTEM AND METHOD FOR PLAYING A TABLE AND ELECTRONIC CARD GAME

(76) Inventor: Joseph Scibetta, P.O. Box 5288, Jersey City, NJ (US) 07305

( * ) Notice: Subject to any disclaimer, the term of this patent is extended or adjusted under 35 U.S.C. 154(b) by 0 days.

This patent is subject to a terminal disclaimer.

(21) Appl. No.: 12/572,721

(22) Filed: Oct. 2, 2009

(65) Prior Publication Data

US 2010/0022288 A1 Jan. 28, 2010

Related U.S. Application Data

(63) Continuation of application No. 12/022,524, filed on Jan. 30, 2008, now Pat. No. 7,618,044, which is a continuation of application No. 10/863,167, filed on Jun. 8, 2004, now Pat. No. 7,331,580, which is a continuation-in-part of application No. 10/458,485, filed on Jun. 9, 2003, now Pat. No. 7,168,705, which is a continuation-in-part of application No. 09/838,897, filed on Apr. 20, 2001, now Pat. No. 6,626,433, which is a continuation-in-part of application No. 09/507,657, filed on Feb. 22, 2000, now Pat. No. 6,220,597.

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 4,804,185 A 2/1989 Noble et al.
5,288,081 A 2/1994 Breeding
5,288,082 A 2/1994 Marquez
5,332,228 A * 7/1994 Schultz ..... 463/13
5,356,140 A 10/1994 Dabrowski et al.
5,395,120 A 3/1995 Malek (Continued)

*Primary Examiner*—Alvin A Hunter
*Assistant Examiner*—Dolores Collins
(74) *Attorney, Agent, or Firm*—Carter, DeLuca, Farrell & Schmidt, LLP

(57) ABSTRACT

The present invention is directed to a card game in which at least five cards are dealt to at least one player position in which the player may have made a wager. The player must make at least one wager corresponding to one or more of the player positions. To initiate a round of play, a number of cards are dealt face down to each of the player positions and one card is dealt to a dealer position. All the cards arc turned face up and each player position card is individually compared to the dealer's card. A winning status occurs for each wagered player position in which the player's upturned card has a higher ranking than the dealer's assigned card. The player is awarded a bonus payout according to a predetermined payout table if the player's cards form at least one of a plurality of predetermined combinations and the player has made a corresponding wager prior to any cards being dealt. In another embodiment, five additional cards are dealt to corresponding dealer positions for determining, as part of a bonus bet, if the player's five cards provide a higher-ranking poker hand than the five-card poker hand formed by the five additional cards dealt to the corresponding dealer positions.

22 Claims, 18 Drawing Sheets

U.S. PATENT DOCUMENTS 5,407,208 A 4/1995 Keller et al.
5,407,209 A 4/1995 Prerost
5,413,353 A 5/1995 Demarest et al.
5,437,462 A * 8/1995 Breeding ..... 273/274
5,486,005 A 1/1996 Neal
5,489,101 A 2/1996 Moody
5,529,309 A * 6/1996 Bartlett ..... 273/292
5,531,448 A 7/1996 Moody
5,607,162 A * 3/1997 Boylan et al. ..... 273/274
5,649,705 A 7/1997 String
5,660,392 A * 8/1997 Hansen ..... 273/274
5,678,821 A 10/1997 Hedman
5,685,774 A 11/1997 Webb
5,690,337 A 11/1997 Somma et al.
5,707,285 A * 1/1998 Place et al. ..... 273/292
5,732,950 A 3/1998 Moody
5,791,989 A 8/1998 Slinkman
5,799,945 A * 9/1998 Boylan et al. ..... 273/292
5,816,914 A * 10/1998 Wichinsky ..... 273/292
5,816,916 A 10/1998 Moody
5,823,873 A 10/1998 Moody
5,839,731 A 11/1998 Feola
5,845,906 A 12/1998 Wirth
5,853,325 A * 12/1998 Kadlic ..... 273/292
5,868,619 A 2/1999 Wood et al.
5,882,260 A 3/1999 Marks et al.
5,897,436 A 4/1999 Singer et al.
5,944,314 A * 8/1999 Stavinsky ..... 273/292
5,957,774 A 9/1999 Holmes, Jr. et al.
5,971,849 A 10/1999 Falciglia
5,976,016 A 11/1999 Moody et al.
6,007,066 A 12/1999 Moody
6,019,374 A 2/2000 Breeding
6,048,267 A * 4/2000 Wichinsky ..... 273/292
6,056,641 A 5/2000 Webb
6,093,100 A 7/2000 Singer et al.
6,098,985 A 8/2000 Moody
6,120,378 A 9/2000 Moody et al.
6,129,357 A * 10/2000 Wichinsky ..... 273/292
6,179,293 B1 1/2001 Hedman
6,220,597 B1 * 4/2001 Scibetta ..... 273/274
6,237,916 B1 5/2001 Webb
6,267,671 B1 * 7/2001 Hogan ..... 463/25
6,273,424 B1 8/2001 Breeding
6,345,823 B1 2/2002 Webb
6,382,629 B1 5/2002 Hill
6,435,507 B1 8/2002 Trucksess
6,454,266 B1 9/2002 Breeding et al.
6,511,068 B1 1/2003 Sklansky et al.
6,543,773 B2 4/2003 Mims
6,595,520 B1 7/2003 Richards et al.
6,612,580 B1 9/2003 Weldon
6,626,433 B2 * 9/2003 Scibetta ..... 273/292
6,698,759 B2 3/2004 Webb et al.
6,712,360 B2 3/2004 Yaple
6,789,801 B2 9/2004 Snow
7,165,770 B2 1/2007 Snow
7,168,705 B2 * 1/2007 Schibetta ..... 273/292
7,331,579 B2 2/2008 Snow
7,331,580 B2 * 2/2008 Scibetta ..... 273/292
7,575,237 B2 8/2009 Snow
7,618,044 B2 * 11/2009 Scibetta ..... 273/292
7,661,678 B2 2/2010 Snow
2003/0153380 A1 8/2003 Dreaper et al.

* cited by examiner

SYSTEM AND METHOD FOR PLAYING A TABLE AND ELECTRONIC CARD GAME

PRIORITY

The present application is a continuation application of U.S. patent application Ser. No. 12/022,524 filed on Jan. 30, 2008 now U.S. Pat. No. 7,618,044 which is a continuation application of U.S. patent application Ser. No. 10/863,167 filed on Jun. 8, 2004 and issued as U.S. Pat. No. 7,331,580 on Feb. 19, 2008 which is a continuation-in-part application of U.S. patent application Ser. No. 10/458,485 filed on Jun. 9, 2003 and issued as U.S. Pat. No. 7,168,705 on Jan. 30, 2007 which is a continuation-in-part application of U.S. patent application Ser. No. 09/838,897 filed on Apr. 20, 2001 and issued as U.S. Pat. No. 6,626,433 on Sep. 30, 2003 which is a continuation-in-part application of U.S. patent application Ser. No. 09/507,657 filed on Feb. 22, 2000 and issued as U.S. Pat. No. 6,220,597 on Apr. 24, 2001, the entire contents of the afore-mentioned U.S. patent applications and U.S. patents are incorporated herein by reference.

BACKGROUND OF THE INVENTION

1. Field of the Invention

The present invention relates to wagering games, and more particularly, but not by way of limitation, to a card game.

2. Description of the Prior Art

Games of chance employing a deck of 52 cards are as old as the invention of cards themselves. The concept of using high cards in which to play and wager in card games is also old. Even so, the prior art discloses many novel patented card gaming tables and many novel patented card games to be played on them.

Card games generally employ one or more cards which, when dealt upon a horizontal surface, determine a score based upon indicia displayed by the upwardly facing sides or faces of the resting cards when the cards are turned face up.

Feola in U.S. Pat. No. 5,839,731 issued on Nov. 24, 1998, describes a novel casino game based on a selected card game in which a player wagers on one or more of a group of dealt hands, i.e. a random grouping or pot of cards and where the chances of winning are not enhanced by the skills of the player and no discretion in the selection is vested in either the player or dealer. A relatively complex card game, such as blackjack, baccarat, or stud poker is selected. A number of hands are dealt as lines or arrays on a playing surface and players wager as to which hand will win. The playing surface has a dealer position including a line or array for each hand dealt to the dealer. Player positions are located in a semicircle around the dealer position, each including a location at which wagers are placed. Winning wagers are paid a multiple of the wager. Optionally, the multiple is based on the odds of obtaining the particular winning combination.

Somma et al. in U.S. Pat. No. 5,690,337 issued on Nov. 25, 1997, disclose a relatively complex casino card game. Utilized is a single, 41 -card deck of playing cards consisting of a standard, 4-suit playing card deck from which all "face" cards have been removed and a single "Joker" card has been added. Play of the game starts with a first player selecting a card value, termed the "dealer number". No bets can be placed on the dealer number. Players may then place their wager(s) on any of the remaining "live" numbers, and the dealer deals a first playing card, face up. If the identified "dealer number" card value is turned over, all players having placed a bet on any of the "live" numbers win, and are paid off even money. If the card has a value other than the "dealer number", the house wins all bets placed on the "value" number of the card that was turned over, and that value number is thereafter considered "dead". Play continues, with the players given an opportunity to place additional bets on the remaining, "live" card values prior to turning over the next card. If the "joker" card is dealt by the dealer at any time before the "dealer number" has been dealt, the house wins all remaining bets, and the game is over.

Boylan et al., in U.S. Pat. No. 5,607,162 issued on Mar. 4, 1997 disclose a method of playing another relatively complex matching wagering game between players and a dealer whose outcome is determined by randomly generated playing cards. After an ante bet is wagered, the dealer deals five cards to each player and deals seven cards to himself. A round of play is then commenced where the dealer plays a card from his hand to present the rank and suit thereof. Next, each player plays a "matching" card from his respective hand which is either the same suit or the same rank. In this manner, each player reduces the number of cards in his hand where a matching card is played during the round. The conducting of a round of play is then repeated until each card in the hand of the dealer has been played. Seven rounds are thus played each game, so that ultimately there are no cards left in the hand of the dealer. The ante bet of each respective player is consequently paid off as follows: (a) To each player if each player has no card remaining; or (b) to the dealer if each player has one or more cards remaining. Preferably, prior to the round of play, each player determines whether his respective hand has a winning hand or position and pays each player who selected the winning hand or position according to the odds and their wager or collects each player's wager who did not select the winning hand or position. Additionally, a jackpot wheel may be included to pennit an added possibility of winning a larger payout.

U.S. Pat. No. 5,395,120 was granted to Malek in March of 1995 for another relatively complex poker-like card game, in particular, a card game suitable for use in casinos, and for a specifically designed table for playing the game. Specifically, this invention relates to a method and apparatus for playing a casino game simultaneously against a dealer and against other players. More specifically, this invention relates to a method of and an apparatus for playing a mixture of draw poker and one off twenty-one and baccarat wherein a player can simultaneously play Draw Poker against a dealer and one of Twenty-one and Baccarat against other players.

Virtually all casinos, especially those in the gaming capitals of the world have board games that are played for gambling purposes. Due to the complexity involved in playing the popular wagering games employing cards such as poker, blackjack, and baccarat, for example, as exemplified by the brief summaries given above, there is a need for a simpler game of chance that will appease all strata of expertise in the art of card gambling, yet remain challenging and enjoyable.

As evinced above, the game of poker is an extremely popular game currently found in most Las Vegas casinos, the rules of which are widely published and have numerous variations. This game provides numerous betting options, but the game involves complicated increasing or decreasing odds depending on the number of decks of cards used. Winning hands may include two pairs, three of a kind, four of a kind, and straights.

Although there have been attempts to improve upon existing card games and to develop new games of chance, none of the prior art card games have been able to overcome the complexity disadvantages described herein. Thus, a need exists for a card game that is simple to learn and play and that results in simpler, more expedient wagering decisions per hour.

SUMMARY OF THE INVENTION

One embodiment of the present invention is directed to a card game to be played by at least one player and a dealer or croupier using at least one standard deck of 52 cards. Also used by the croupier is a shuffling machine for cards, a dealing machine for cards and a catch bin for discarded or played cards. The order of play and payoffs for each bet are set by the house or the croupier.

The card game of the present invention is played by a player first placing a bet, preferably in a betting spot using chips, for example. Next, the dealer deals a predetermined number of cards to each player face down onto an area on the table—called a pot—designated for that player and afterwards, deals the same number of cards to another area on the table, called a dealer's pot. One play in a series includes the dealer turning up a player's top card and turning up the dealer's top card: High wins at even odds of 1 to 1; equal cards are a draw or push and neither wins except if a player has a deuce in which case the player's deuce loses 1 to 1 odds; a player's ace wins at odds of 3 to 2. After one play, a player may place a new bet before cards are next turned over. As an example, in a typical round involving the dealer and a player playing one hand, assume the dealer turns over a eight of spades as his upturned card and that the player turns over a Queen of hearts as his upturned card. In this case, the player wins the round and is paid off at 1 to 1 odds. It is to be understood that the odds described above are merely exemplary and may be different depending upon the pay out rules associated with each gaming establishment in which the inventive game is played.

The inventive card game, while exhibiting many valuable gaming features, as explained below in more detail, also can be inexpensively manufactured and incurs minimal operational overhead expenses. While the present invention may, in one embodiment, includes a separate, approximately five-foot semi-circular table, the present playing surface may be formed as a thin overlay to be placed atop existing casino game table equipment such as blackjack tables. In addition, if there are an insufficient number of players to warrant operating a full table, the table may be split in half, with one half of the table unoccupied, and the other half utilized for playing the game. Advantageously, the operational expenses associated with the present game are low. To operate the present game, the casino need only employ one dealer.

While the method of the present invention has been described in connection with a live gaming table format using a live dealer to deal the cards and handle the wagering, the method of play may also be practiced in a non-wagering (amusement) format in which points, chips, artificial money, and so on are used instead of items of monetary value. The amusement format can be a live table game or a hand-held computer game similar to the electronic amusement game. Moreover, a personal computer or a small hand-held device can be programmed or to designed to play the game. It is also contemplated that the game can be played via a terminal connected to an on-line network, such as the Internet. In the on-line network form, it is possible that a plurality of players may participate in a single game. The game of the present invention can also be embodied in an electronic apparatus for use on an airplane for those airlines provide gambling opportunities when flying over international waters or nations that allow it.

The card game has a minimal number of rules, and the rules are readily apparent to the novice gambler after very little observation.

In an embodiment of the inventive card game, every wager is effective until some predetermined number of cards are compared. Therefore, in contrast to the prior art card games, such as blackjack, the present game produces simpler wagering decisions. Thus, the present invention represents a substantial improvement over casino games of the prior art because it simplifies play and encourages wagering which in turn leads to increased entertainment for the player.

In another embodiment of the present invention, a player is provided the option of playing the novel game against on a computer over the internet or using a gaming device including a video display and means for interacting with the video display in a casino-style game environment.

In accordance with one aspect of the above embodiment, the inventive card game is played as a secondary game in the gaming device wherein the gaming device includes a primary game and a secondary game where the secondary inventive card game is only invoked when a particular sequence or outcome is achieved in the primary game, as will be described below.

An advantage of the card game of the present invention over prior art card games is that it is substantially less complex thereby enabling the game to move quickly which decreases the associated operational overhead.

A further advantage of the card game of the present invention is its simplicity and accessibility to the ever-increasing numbers of novice gamblers. Therefore, despite the popularity of both craps and roulette, the inventive card game presents several advantages to the casinos and players alike.

A still further advantage of the card game of the present invention is the simplicity of betting wherein a winning bet is easily recognized. Players advantageously compete against the house with virtually even odds based on a variation of high card wins, like cards draw or push, and players' aces provide an advantage to the player. It is further noted that the pay out tables may vary in accordance with house rules as determined by each gaming establishment. Moreover, with respect to the slot machine version of the inventive game, the payouts will be more streamline from gaming establishment to gaming establishment, in that each gaming establishment is subject to certain payout guidelines as determined by an overseer gaming commission.

A gaming method disclosed is designed to quickly build excitement and anticipation by turning over a predetermined number of cards from a dealt hand per game, and as such is intended as a quick paced and an unusually exciting game to play and/or observe. Even more particularly, the instant invention is intended to give a novel and new look and feel to the currently popular card games yet have simplified rules and procedures designed both to encourage use by novice gamblers.

BRIEF DESCRIPTION OF THE DRAWINGS

These and other features, aspects, and advantages of the present invention will become better understood with regard to the following description, appended claims, and accompanying drawings wherein:

DETAILED DESCRIPTION OF PREFERRED EMBODIMENTS

Figure 1:
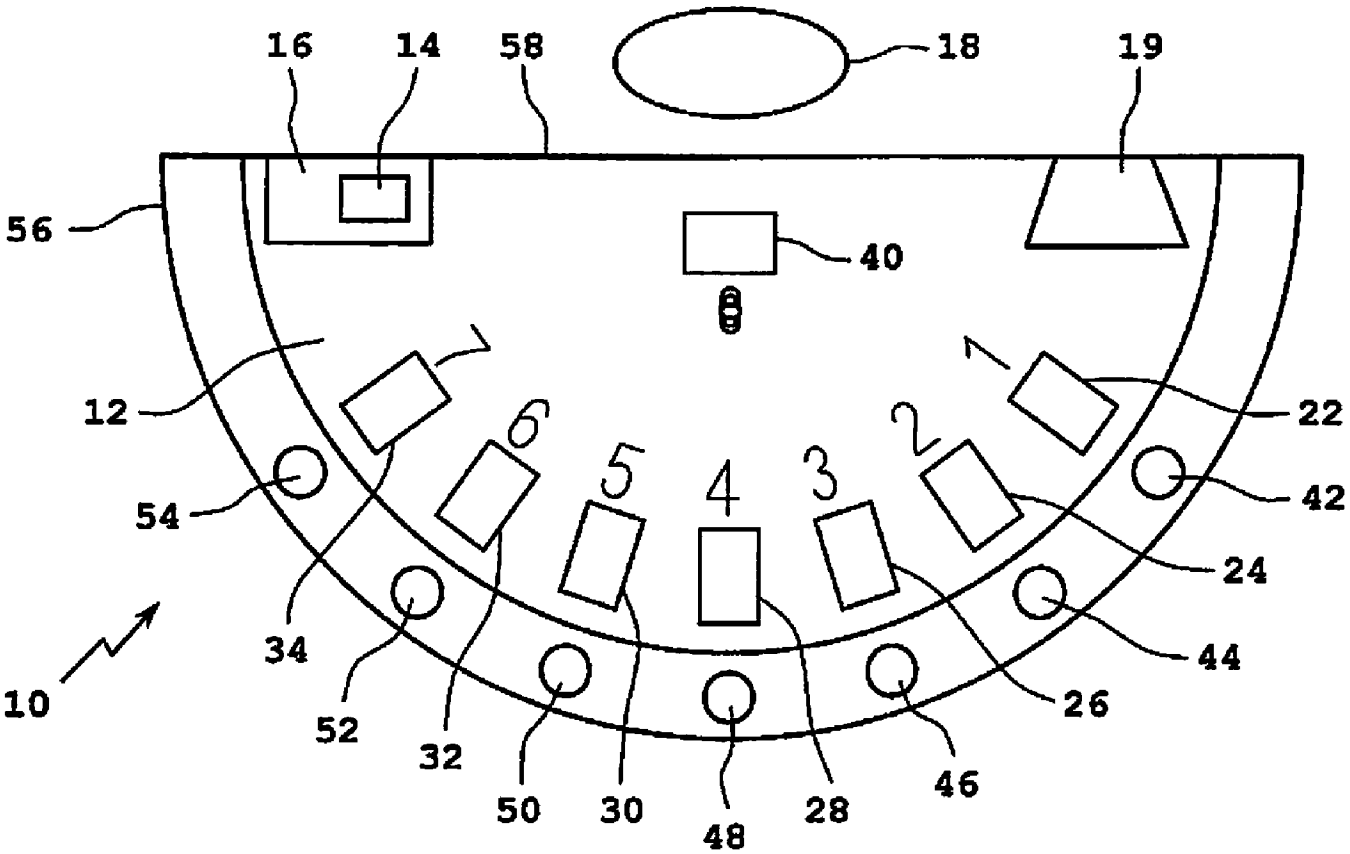
FIG. 1 is a top plan view of a table or board layout of the present invention.

The present invention will be described hereinafter with reference to the accompanying drawings and the rules of the card game provided herein which illustrate an embodiment of the invention.

The table card game and method of playing the same of the present invention incorporates the following rules when playing the table version and for the electronic version of the game:

Exemplary Rules of the Table Card Game

1. The improved game is played on a casino-type card table. There are eight spaces for the pots to be placed on the table (see FIG. 1). A circular space isolated near each pot except to pot designated for the banker, dealer, croupier, or house. A pot is defined herein as a pile of cards initially placed face down. The circular space is adapted to receive bets or wagers via chips or tokens. In the inventive novel card game there are a maximum of eight pots inclusive of a pot for the banker or dealer of cards during the play of the game. The last pot shall always be assigned to the banker or dealer.
2. To play the game, all initial bets are made before the cards are dealt. All of the dealt cards are dealt face down into the eight pots after the initial bets or wagers are placed in the circular spaces. The cards or pots (piles of cards) are dealt only to those spots where bets have been put down on the table. However, the dealer always receives a pot. The dealer may be either a person or a mechanized card dealer operated by a croupier.
3. Next, the dealer or croupier shall count out six cards (or any number of cards) for each pot sequentially, first with six cards face down for the first pot, etc. If seven bets have been placed at each of the seven spots then eight piles of six cards each are dealt onto the table for each of the seven pots plus one for the dealer or banker. The only pots are those dealt to players. The pots are located in front of players who have placed wagers.
4. After the wagers are placed on the table by the players (the game is preferably limited to up to seven players and one dealer or banker) and the pots are in place on the table, the dealer turns over the top card from each pot or pile of cards. In the novel game, all deuces are nullities and players with deuces lose the respective round.
5. The dealer or banker pot card at the top is turned up last. All pot cards are turned up from the dealers left to the dealer's right. If a dealer's card matches a players upturned card these rules designate this event as a push or draw and neither the player nor the dealer wins or loses except if the players upturned card is either an ace or a deuce and the dealers upturned card is also an ace or a deuce, respectively. The player's ace wins his wager at odds of 3 to 2; the player's deuce loses. Otherwise, when a player's upturned card matches a dealer's upturned card the player wins at even odds of 1 to 1. As an example, in a typical round involving the dealer and a player playing one hand, assume the dealer turns over a eight of spades as his upturned card and that the player turns over a Queen of hearts as his upturned card. In this case, the player wins the round and is paid at 1 to 1 odds. It is to be appreciated that the 1 to 1 odds are merely exemplary and may be different depending upon the pay out rules associated with each gaming establishment in which the inventive game is played.
6. The dealer or house shall be able to set limits on wagers at all times during the game and before a play. A play is defined the act of upturning the top card of each pot. After a play resulting in win or a lost a new wager can be placed by the player.
7. The cards shall only be handled and touched by the dealer. At the option of the dealer or house if a player touches a pot, that pot may be discarded.
8. At the option of a dealer announces "no more bets", new bets cannot be added to the table or removed from the table. The dealer shall announce end declare that wagering is closed before the first pot is dealt and for each player before a next card is upturned.
9. At the option of the dealer, a plurality of card decks may be used to play the game.

These rules define a game that is virtually a head to head play against the dealer or house with almost even odds. The house or dealer can change and/or set the minimum and maximum wagering limits at any time during play.

The inventive method specified by the above rules is best described by referring again to FIG. 1. There is shown a top of a table 10 with a specific and preferred layout on the surface 12. In the novel game, a combination card deck 14 and shuffling machine 16 is used to deal cards from the card deck 14 onto the surface 12 by a dealer or croupier 18. A receptacle means 19 or space is designated on the table 10 for receiving cards discarded during play of the game.

Shown in FIG. are seven playing areas or pots 22, 24, 26, 28, 30, 32, and 34. Also shown is an eighth pot 40, designated as a "dealer's pot". It should be appreciated that the number of playing areas is not restricted to seven, but can be a greater or lesser number depending upon the preference of the house conducting the game. Seven positions will be used to describe one embodiment for ease of explanation.

In front of each of the pots 22, 24, 26, 28, 30, 32 and 34 are betting spots 42, 44, 46, 48, 50, 52 and 54, respectively, where players (not shown) located about an edge 56 of the table 10 make bets either with money or chips, for example.

The seven playing areas or pots 22, 24, 26, 28, 30, 32 and 34 are visibly and distinguishably marked with a designation such as a different numeral proximate to each of same, i.e., Arabic numbers 1, 2, 3, 4, 5, 6, and 7 as shown in FIG. 1. The dealer's pot 40 is similarly distinguished and marked with an Arabic numeral 8 proximate thereto, for example. It should be appreciated that while seven player positions are shown, a single player could control one or more of the seven player positions in any round of play.

A third area wherein the dealer's pot 40, rectangular in configuration, for example, is shown is near a straight edge 58 of the table 10.

Any odds may be assigned or established by the house for payout of winning bets placed in any of the aforesaid seven separately delineated areas, playing areas or pots 22, 24, 26, 28, 30, 32, and 34, for example. Payout ratios may be from 2 to 1 for the most likely to win a bet in integer increments up to 10 to 1, for example, for the least likely to win a bet and depend upon the number of decks used for example. The house may establish an initial order of play including which players are designated as first player, second player, and so on to a last player.

While the card game has been described, in accordance with one embodiment, as a table game to be played in a casino gaming environment, it should be appreciated that the card game can be played in a wide variety of formats including, for example, on a computer video machine game, on a large screen or television monitor, as a home television/computer video game, a video arcade game apparatus, a personal computer system (desktop or portable), a "network computer", a television including or connected to a microprocessor (e.g., a set top box) for Internet or other information access, incorporated into an Internet or intranet environment, or other apparatus.

The following is a description of a method of playing the inventive card game adapted for machine play on a video machine in a casino gaming environment. In this regard, the present invention also relates to apparatus for performing these operations. This apparatus may be specifically constructed for the required purpose or it may comprise a general purpose computer as selectively activated or reconfigured by a computer program stored in the computer. The procedures presented herein are not inherently related to a particular computer or other apparatus. Various general purpose machines may be used with programs written in accordance with the teachings herein, or it may prove more convenient to construct more specialized apparatus to perform the required method steps. The required structure for a variety of these machines will appear from the description given.

Figure 2:
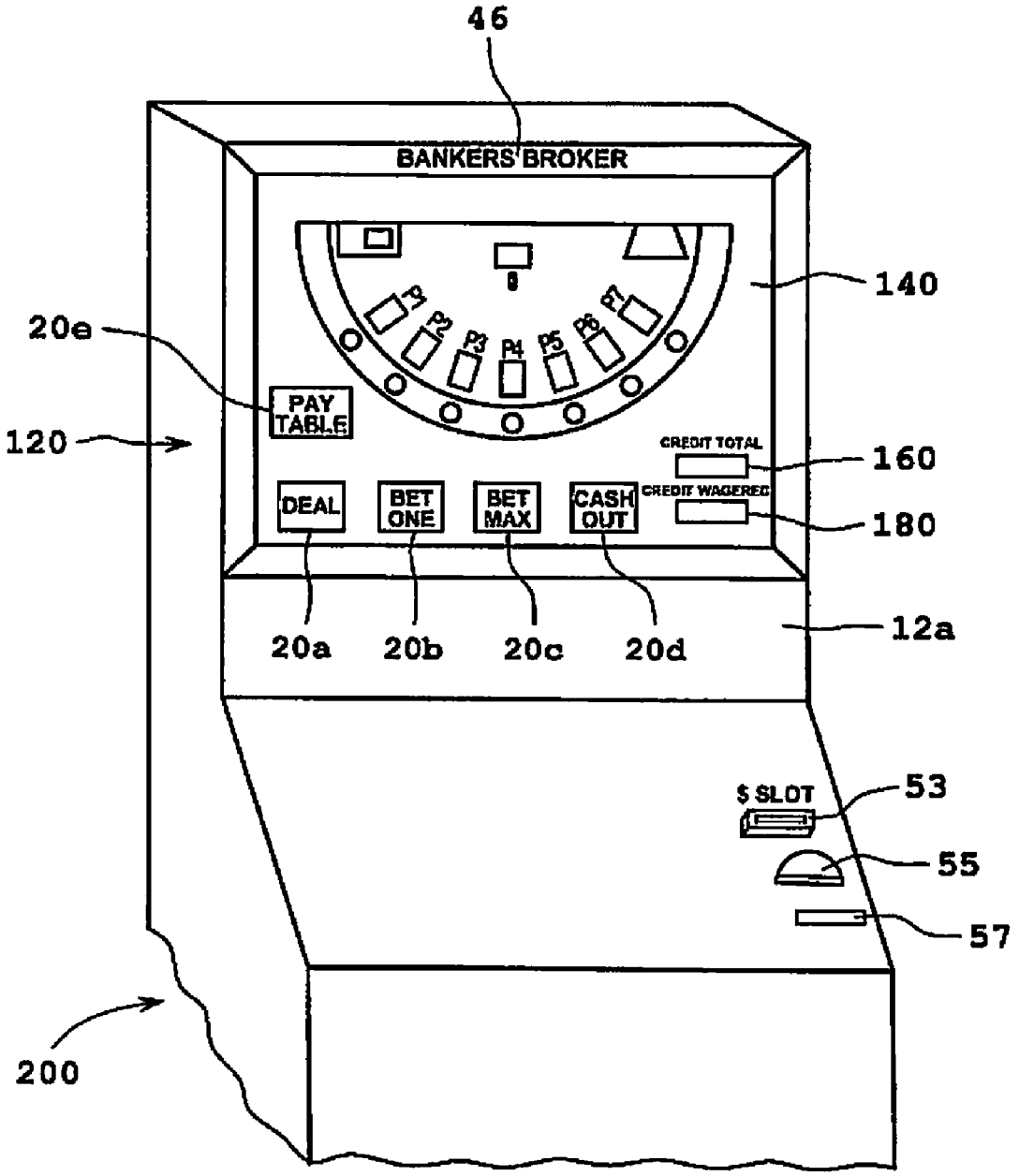
FIG. 2 is a perspective view of a computer video machine embodying the present invention.

Referring now to FIG. 2, a video gaming machine 200 is illustrated. The gaming machine 200 includes a housing 120 of conventional design having a touch screen video display terminal 140 predominantly located on the front face 12*a* of the housing which displays the various presentations during the play of the game. The machine 200 includes means for enabling the player to make a wager. These means, where the game is played for purely enjoyment, may simply be means for the player to wager fictitious credits. Alternatively, as shown in the drawings, where the machine 200 is used in a gaming establishment, such as a casino, the machine 200 may include a coin slot 53 and a bill acceptor 55 so that credits to play the machine 200 can be purchased. Additionally, means may be provided for the player to wager from finds on a debit card or the like as known in the art. A dispensing slot 57 allows receipts to be dispensed from the housing 120. Credits accumulated in the machine 200 are printed on the receipts before they are dispensed so that a player may redeem purchased and/or accumulated credits for negotiable currency. Although not shown, the machine 200 also includes a sound board and outputs audio information in the form of "tunes", "bells" etc. during game play.

The machine 200 further includes a video display terminal 140 which illustrates a top view of an image of a game table having a number of player positions such as seven player positions shown as P1 through P7, and a banker position, shown as B. It is to be understood that the number of player positions is not restricted to seven. A lesser or greater number of positions 110 is within the scope of the invention. Further, it is to be understood that the game can be played with a different layout or without the use of a game layout and still be within the scope of the invention.

Figure 3:
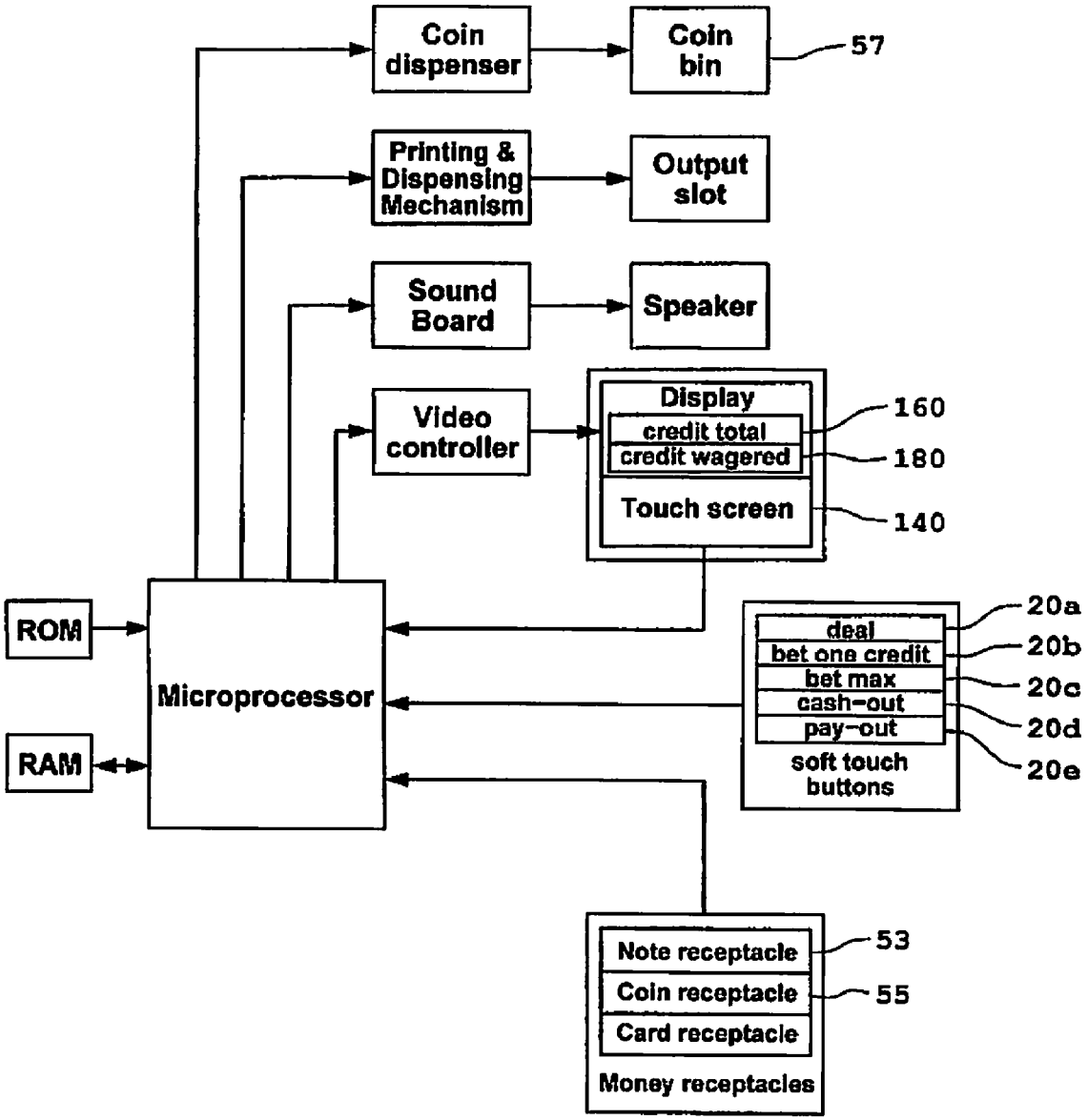
FIG. 3 is a block diagram of the computer video machine shown by FIG. 2.

With continuing reference to FIG. 2 and also to FIG. 3, means are provided for the player to control the play of the game and make various selections as hereinafter described. These means may be preferably embodied by providing the described video display terminal 140 with touch screen capability, well known in the art, or, alternatively, by providing a plurality of push buttons or some combination thereof. With reference to the touch screen display implementation of the present invention, also displayed at the display 140 are a number of touch screen regions or "soft buttons" such as deal 20*a*, bet one 20*b*, bet max 20*c*, cash-out 20*d*, and pay-table 20*e* which are activated by touching the display 140 over the respective touch screen region. Display terminal 140 also includes a credit total window 160 and a credits wagered window 180. The credit total widow 160 shows credits accumulated in the machine 200 and the credits wagered window 180 shows the total number of credits wagered 180 for each round of play. As payouts are made, credits are added to the tally as shown in the credit window 160, in a known manner. Display terminal 140 also optionally includes a game logo, i.e., "Bankers Broker" 46. It is also possible to use other input devices for playing the game such as a button panel, keyboard, mouse, joystick, trackballs or other pointing and GUI devices and the like, and the machine 200 may include LED or LCD displays, which may be fixed in the housing, but these are not shown or described herein.

Within the housing 120 of the machine 200 is located a microprocessor-based circuit (not shown) which includes appropriate ROM, RAM, a video controller and a microprocessor together with other circuitry and components necessary to operate the machine 200. Circuits of this type are well known to those of skill in the machine art and therefore will not be discussed is herein.

The microprocessor-based circuit performs a variety of functions necessary to control the operation of the machine 200. In particular, the microprocessor-based circuit monitors the money receptacles 53, 55 to determine the amount of money inserted into machine 200 to purchase credits and adjusts the credit total accordingly. A bin (not shown) is located below the money receptacles 53, 55 to collect money deposited in the housing 120. A printing and dispensing mechanism is in communication with the microprocessor-based circuit and prints the accumulated credits on a receipt and dispenses the receipt when the cash-out button 20*d* associated with terminating game play is pressed by a player. The machine 200 also includes a cash out button 20*d* to enable the player to prompt the processor to distribute to the player in a known fashion accumulated credits in the form of coins or tokens. The player has the option of cashing out the accumulated credit total and redeeming the credit total for negotiable currency. If this option is selected, the machine 200 prints the credit total on a receipt and dispenses the receipt through the slot 57. The microprocessor-based circuit then clears the credit total window 160 to zero. The microprocessor-based circuit also prints and dispenses a receipt and clears the credit total window 160 when the credit total exceeds a predetermined value Rather than dispensing printed receipts in the event of a win, the machine 200 can include a coin bin (not shown) instead of receipt dispensing slot 57 and dispense coins in the event of a win. The machine can also incorporate both the coin bin and the dispensing slot 57 allowing a player to select the form in which accumulated credits in the machine are to be redeemed. If the cash-out button 20*d* is pushed by a player, the microprocessor-based circuit requests the player to confirm that it is the player's intent to terminate game play via information displayed on the display terminal 140 so that accidental use of the cashout button 20*d* does not automatically result in the termination of the game. When game play is terminated and the receipt has been dispensed, the microprocessor-based circuit zeros the credit total window 60. As long as the credit total widow 160 in the machine 200 is above zero, a player can continue to play.

When a positive credit total is shown in the credit total window 160, the microprocessor-based circuit monitors the soft-touch buttons 20*a* to 20*e* and alters the screen display 140 depending on the soft-touch buttons pushed. After one game play, if the player does not enter new bets for the following game play, the microprocessor-based circuit uses the wager made during the previous game. The player can play until the credit total window 160 goes to zero in which case more money needs to be deposited into the machine 200 to continue play. When this occurs, the machine 200 notifies the player and gives the player a predetermined amount of time to deposit more money. If the player fails to deposit more money, the microprocessor-based circuit goes into an attract mode and conditions the screen output in accordance with preprogrammed information therein. In the attract mode the microprocessor-based circuit controls the output of the display screen 140 in accordance with pre-programmed information stored in the microprocessor-based circuit's memory. The output of the screen display simulates game play and in this mode is designed to attract players to the machine 200.

A bet one credit button 20*b* is provided to enable the player to wager credits from a minimum wager up to the maximum available for wagering at the machine 200. A max wager button 20*c* enables the player to make a maximum wager to play the game and simultaneously initiate play of the game. This is conventional with present day gaming machines.

The deal button 20*a* enables the player to prompt the processor to initiate play where a maximum wager is not made The payoff amounts in the basic game are predetermined according to a pay table stored in system memory. The payoff amounts corresponding to the game played as a secondary game are also stored in system memory. Winning basic game outcomes are identifiable to the player by a pay table. In one embodiment, the pay table is affixed to the machine 10 and/or displayed by the video display 140 in response to a command by the player (e.g., by pressing the Pay Table button 20*e*.

The method of the present invention adapted for play on a gaming machine 200 in a casino style format will now be described with reference to FIGS. 3-8 which are screen displays utilized to play the inventive card game in a casino like environment.

A player indicates a desire to play a round by depositing money in the machine 200 via the coin slot 53 or bill acceptor 55, as illustrated in FIG. 2. Alternatively, if there is an existing credit line displayed in the credit total window 160, the player may make a wager from the existing credit line. In the case where the player elects to deposit money into the machine 200, via the coin slot 53 or bill acceptor 55, the microprocessor-based circuit detects this and increments the credit total window 160 to a value dependant on the total amount of money deposited into the gaming machine 200 plus any pre-existing credits.

Irrespective of whether a player deposits additional funds in the machine 200, or instead use the existing credit line, to initiate play, a player is required to press the deal button 20*a* causing the microprocessor-based circuit to display the next screen.

Figure 4:
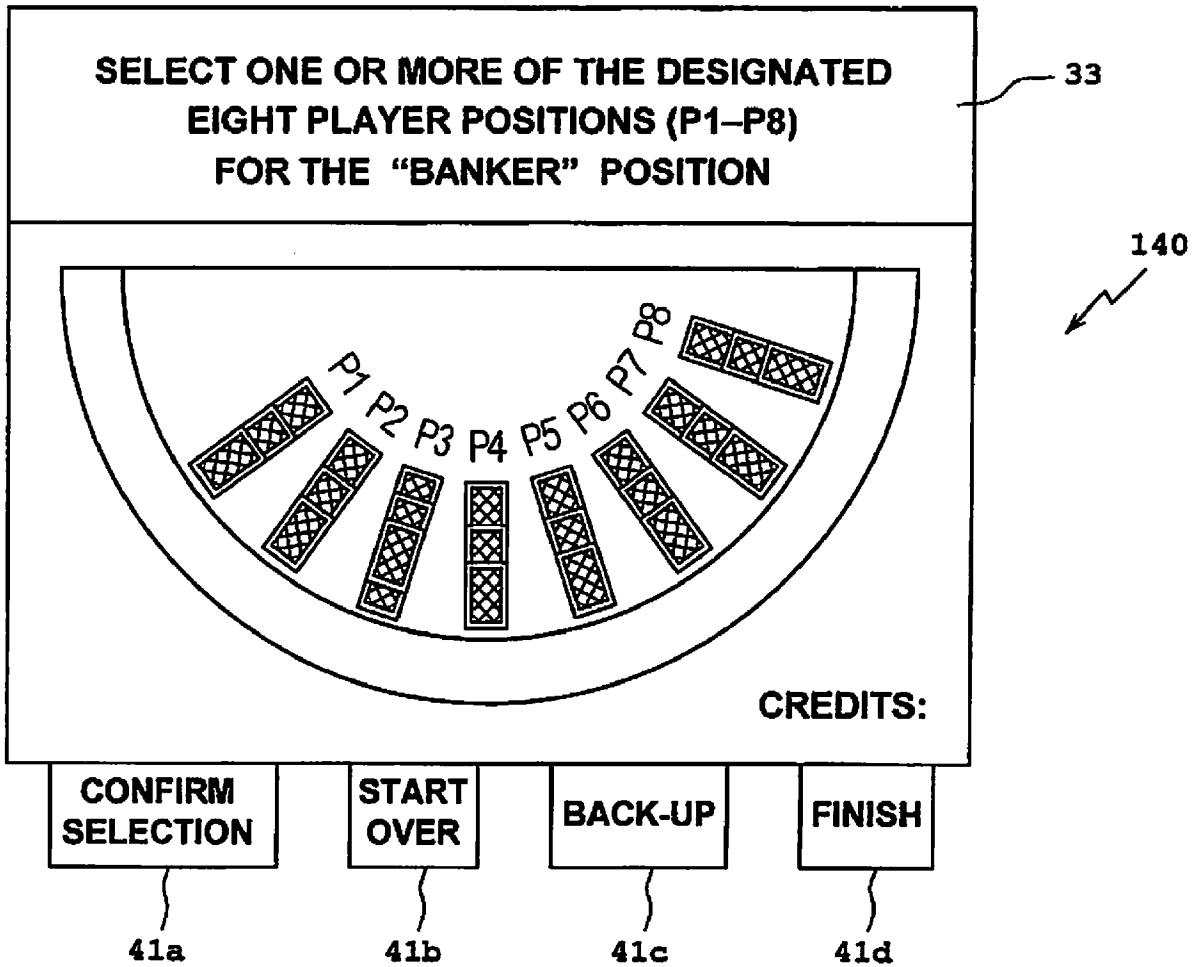
FIGS. 4-8 illustrate views of a display screen of the computer video machine of FIG. 2 illustrating various aspects of playing the inventive game.

In response to the player pressing the deal button 20*a*, FIG. 4 illustrates an optional screen which may be displayed in accordance one embodiment of the present invention in which eight hands are dealt to eight player positions from which the player is required to choose the banker (i.e., B position). This embodiment is differentiated from a preferred embodiment in which the banker position is predetermined. In the present embodiment, recognizing that all dealt cards are face down at the point of making a banker selection, no advantage may be realized by the player. However, this embodiment affords an opportunity for the player to participate further in the processes of the game. The decision to incorporate this optional screen will be made at a manufacturing stage.

Figure 5:
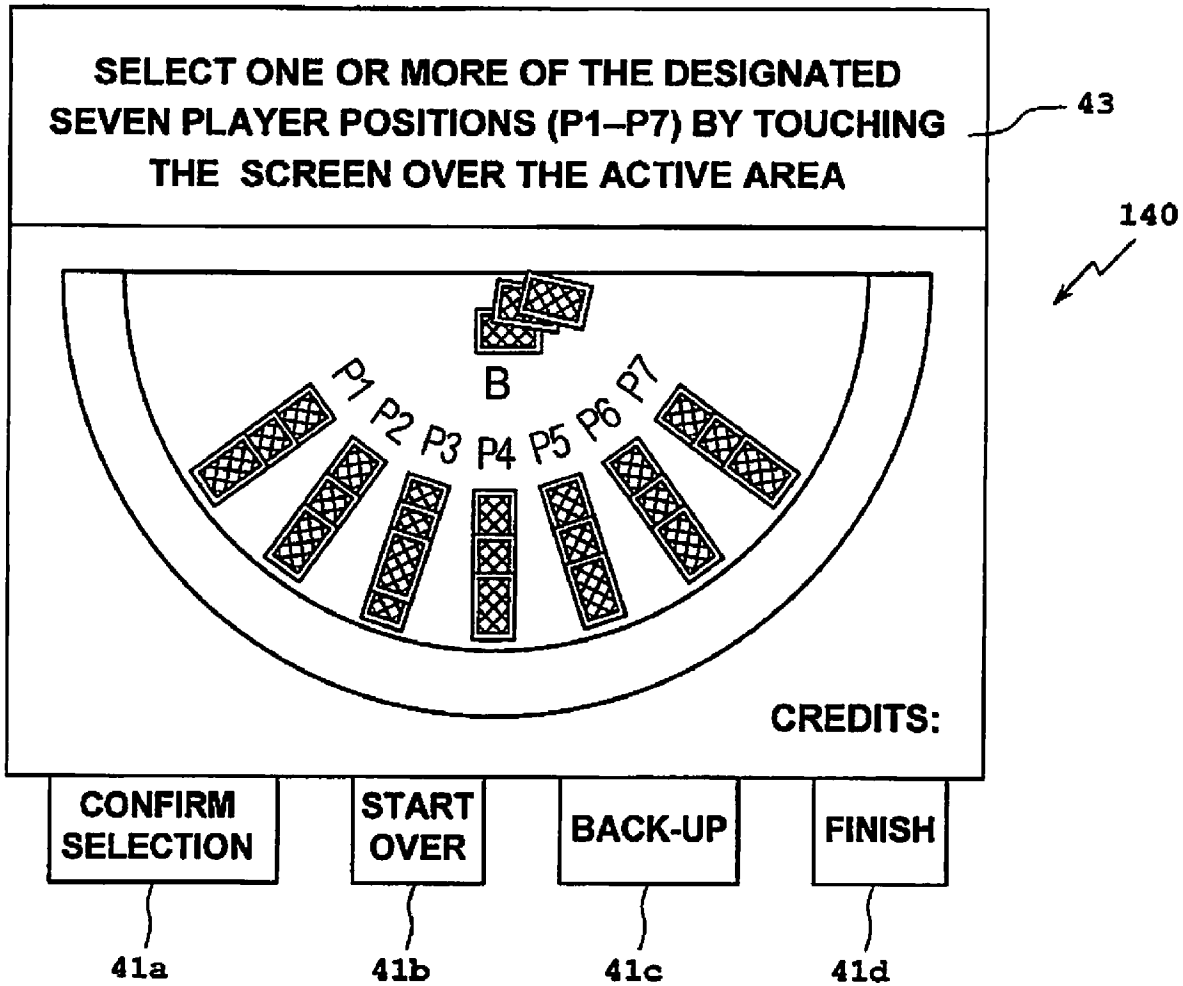

FIG. 5 illustrates a next screen shown to the player in two situations. First, FIG. 5 is displayed in response to the player pressing the deal button 20*a* at the screen displayed to the player in FIG. 2. Second, FIG. 5 is shown to the player as a next screen subsequent to the player selecting a banker position from among the eight displayed positions from the optional screen displayed in FIG. 4.

FIG. 5 illustrates a grouping of cards dealt face down to seven player positions and a banker position. Preferably, six cards are dealt face down to each of the eight positions. It is noted that a lesser or greater number of cards than six could be dealt to each position. Six cards constitute a preferred number of dealt cards in the case where a single deck of 52 cards is used whereby 48 of the 52 cards would be dealt in each round of play. It should be appreciated, however, that dealing more or less than six cards in a round will not affect the statistical outcome of the game.

Conventionally, the microprocessor-based circuit simulates the dealing of cards in a rotation to each player and to the banker until each player as well as the banker has been dealt six cards face down. Of course, if desired, the requisite number of cards could be consecutively dealt to each player and the banker.

FIG. 5 also includes a prompt 43 requesting that the player select one or more of the seven player positions, P1-P7 to be played (i.e., wagered on) in that round. The player may elect to wager on any combination of player positions, or a single player position, from among the seven eligible positions, P1-P7 in each round of play. For example, a player can choose to play positions P1 and P4, P2 through P7, P3 alone, or P1-P7. The selection is made via the touch-screen by touching the screen at the site of each desired player position. Upon touching a player position site, the site will be highlighted in some manner and the player can confirm or cancel the selection by pressing the confirm-selection 41*a* button or the cancel 41*c* button, respectively. Further, the player can elect to start-over and erase all previously made selections by pressing the start-over 41*b* button. Once the player is satisfied with all of his/her selections, the player would then press the finish 41*d* button to lock in the selections and advance to the next screen.

Figure 6:
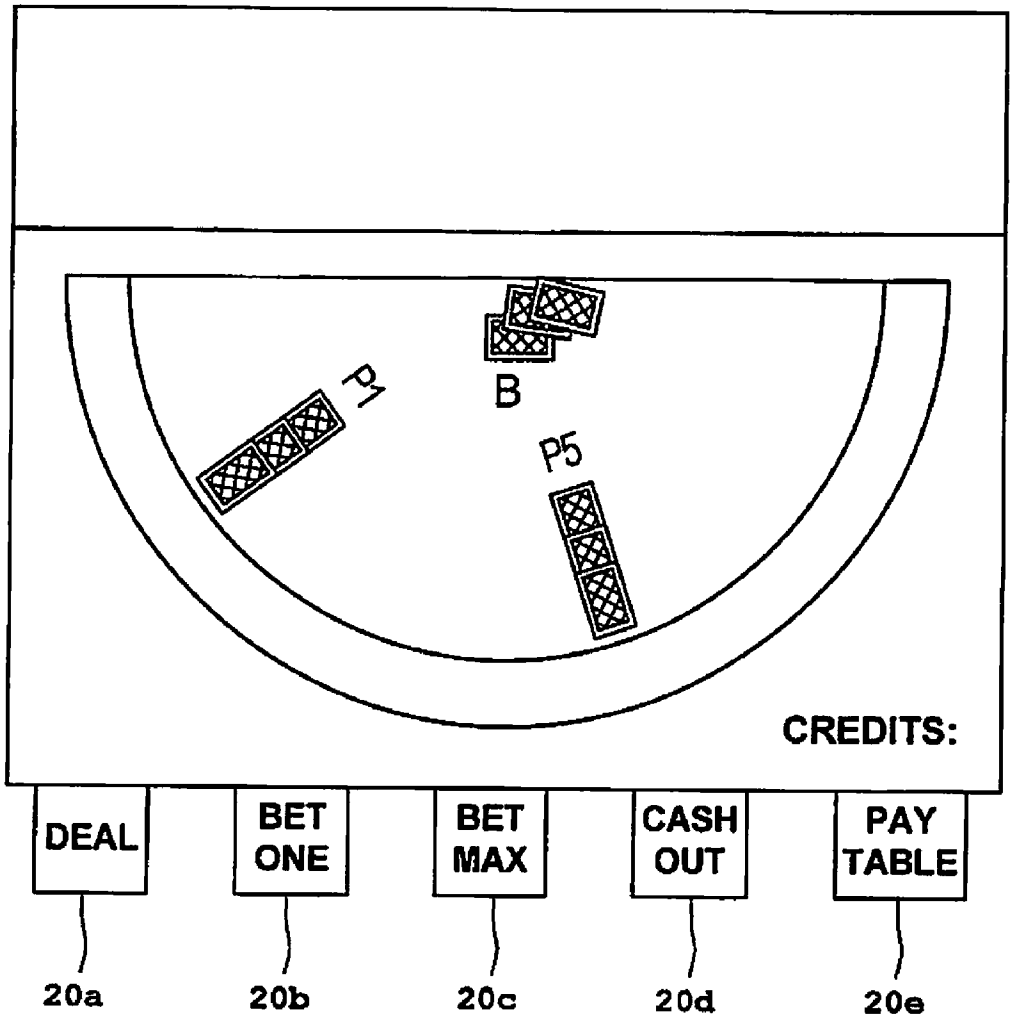

FIG. 6 illustrates a screen display of a player selection of two hands (i.e., P1 and P5) to be wagered upon in a round of play. As shown, the unselected player positions (P2, P3, P4, P6 and P7) are removed from the display 140 leaving only the cards associated with the selected player positions P1, P5 and the banker position, B.

Figure 7A:
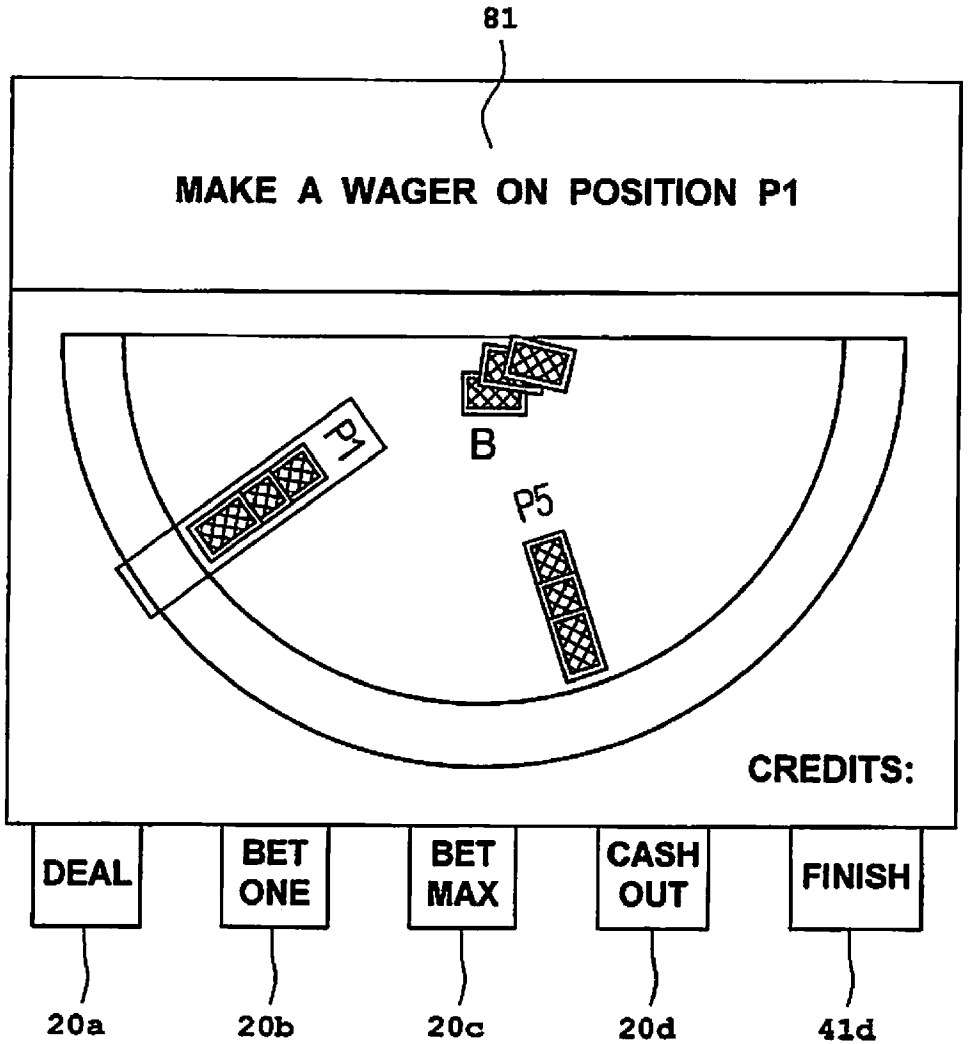
Figure 7B:
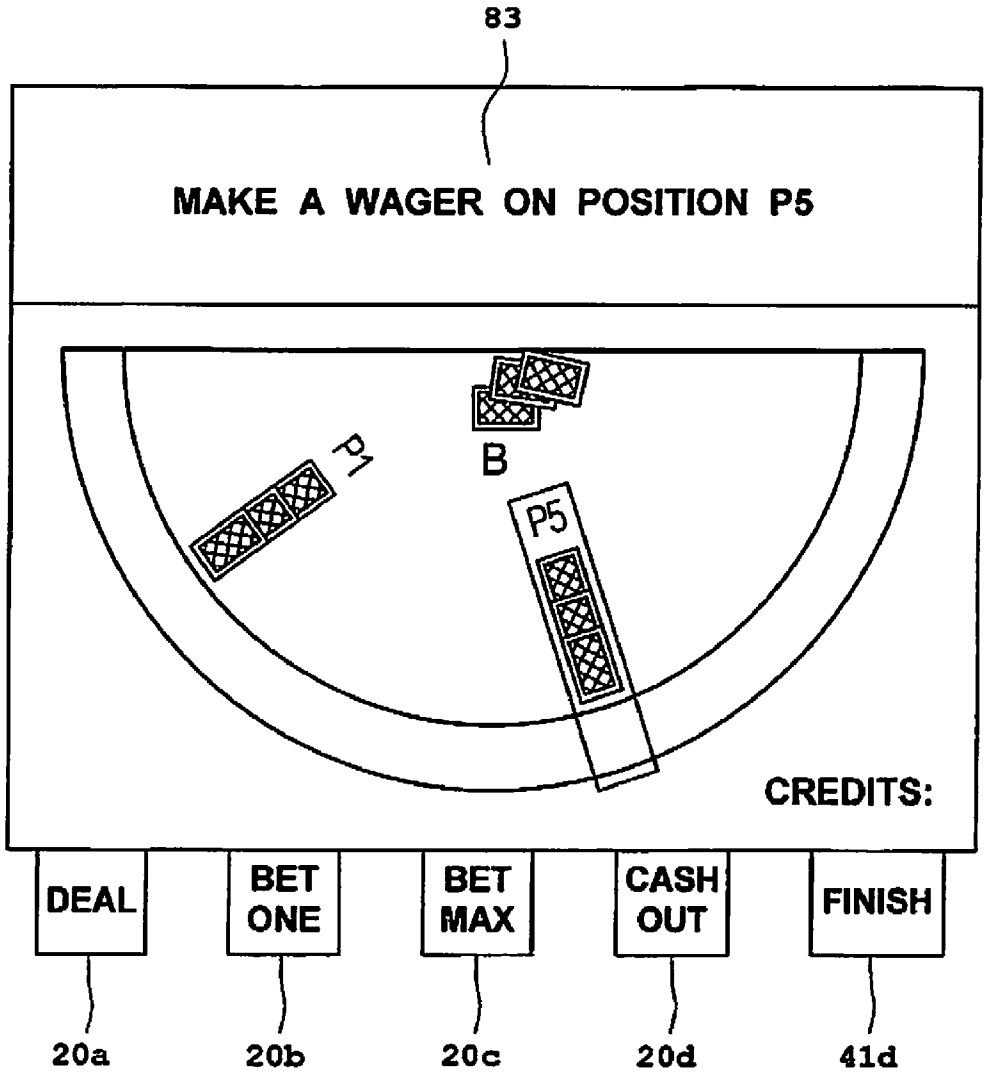

FIGS. 7*a* and 7*b* are illustrations of how the player makes a wager on each of the selected hands (e.g., P1 and P5). In FIG. 7*a*, the player is prompted 81 to make a wager on the first elected position, P1. The display 140 illustrates player position P1 encapsulated. A player position is wagered upon by depressing one of the two touch screen buttons associated with making a wager, bet-one 20*b* and bet-max 20*c*. By touching the screen over the bet-one button 20*b*, the player can wager in increments of a single unit. In this case, a player must indicate that he/she is finished wagering on the highlighted position by pressing the finish button 20*e* causing the microprocessor-based circuit to highlight the next elected position (e.g., P5). An alternative is to pressing the bet-one 20*b* button is the bet max 20*c* button which records a maximum wager by depressing the screen over this area. In the present example, FIG. 7*b* highlights the next position, P5, to be wagered on by the player. The steps for making a wager are identical for each player position wagered on.

Once the wagering is completed in the current round, the rules for playing the card game are identical to that described above with reference to the casino table embodiment (See: Rules of the Game). Briefly restated, all deuces are nullities and players with deuces lose the respective round. In accordance with the rules of the inventive card game, if a dealer's upturned card matches a players upturned card the rules designate this event as a push or draw and neither the player nor the dealer wins or loses except if the players upturned card is either an ace or a deuce and the dealer's upturned card is also an ace or a deuce, respectively, the players ace wins his wager at odds of 3 to 2; the players deuce loses. Otherwise, when a player's upturned card matches a dealer's upturned card the player wins at even odds of 1 to 1. In the event a player's card is greater than the banker's upturned card, the player wins the wagered amount. Otherwise, the player loses the wagered amount in the event the player's card is of a lower denomination than the banker's card. It should be appreciated that the payouts described herein are merely exemplary. In actual operation, the payouts will be determined, in large part, subject to predetermined casino rules and/or government regulations.

Figure 8:
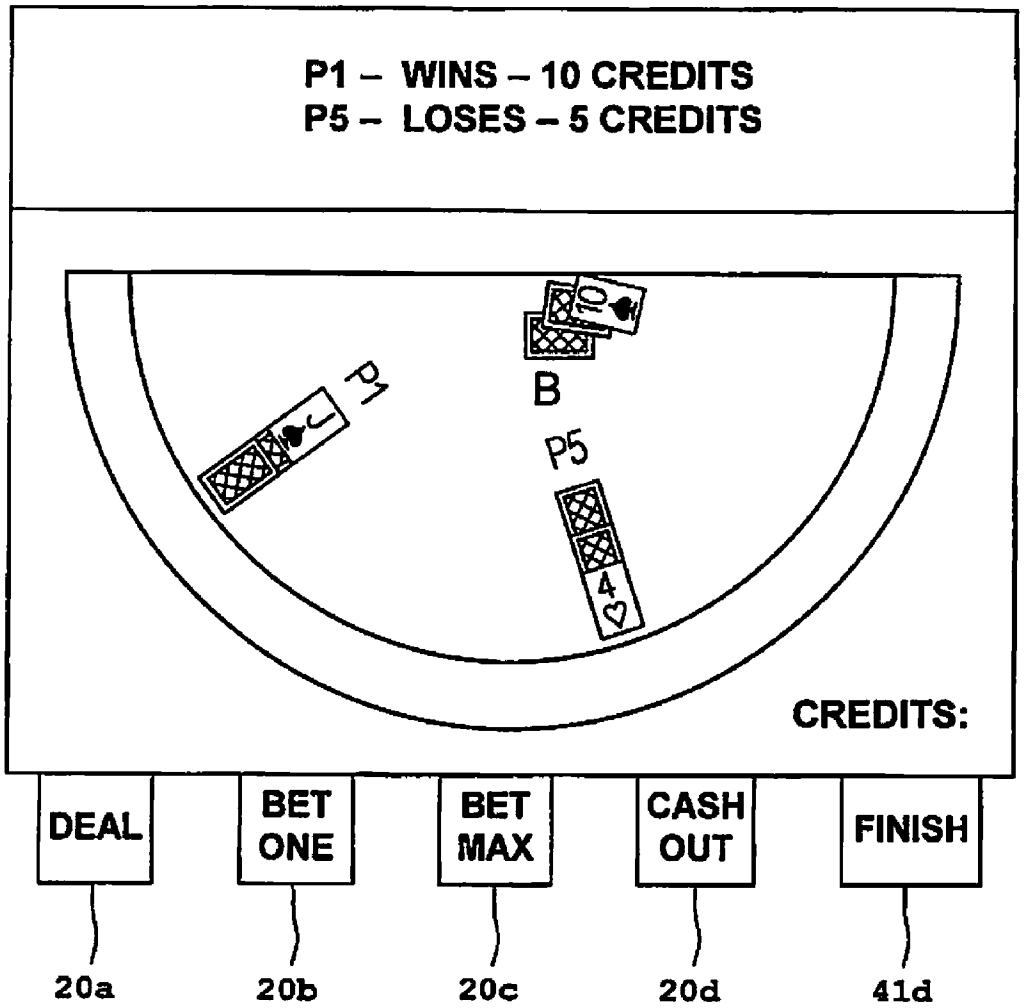

FIG. 8 illustrates an exemplary result for the exemplary round in which two player positions are elected, P1 and P5. In accordance with an embodiment of the invention, a bottom card is turned over for each of the elected player positions P1 and P5 and for the banker position. The bottom card upturned for player position P1 is the Jack of hearts, a bottom card upturned for position P5 is the four of hearts and the banker's bottom upturned card is a ten of spades. In accordance with the rules of the game, the upturned card for each elected player position is evaluated against the banker's upturned card to determine a winning or losing status. Specifically, for the exemplary round illustrated in FIG. 8, the player has a winning status for position P1 and a losing status for position P5.

To illustrate the wagering aspect of the game, assuming the player had an existing credit line of 500 units, for example, prior to the exemplary round of play and had wagered 10 units on player position P1 and 5 units on player position P5. The player would have a net effective credit line of 505 units at the end of the exemplary round. The player wins 10 units on winning position P1 and loses 5 units on losing position P5.

Upon paying the player, either in the form of credit for a next round of play or by returning an appropriate credit amount, the exemplary round is said to be terminated. At this point, the player may elect to play another round or redeem any existing credit which may have been previously accumulated.

Figure 11A:
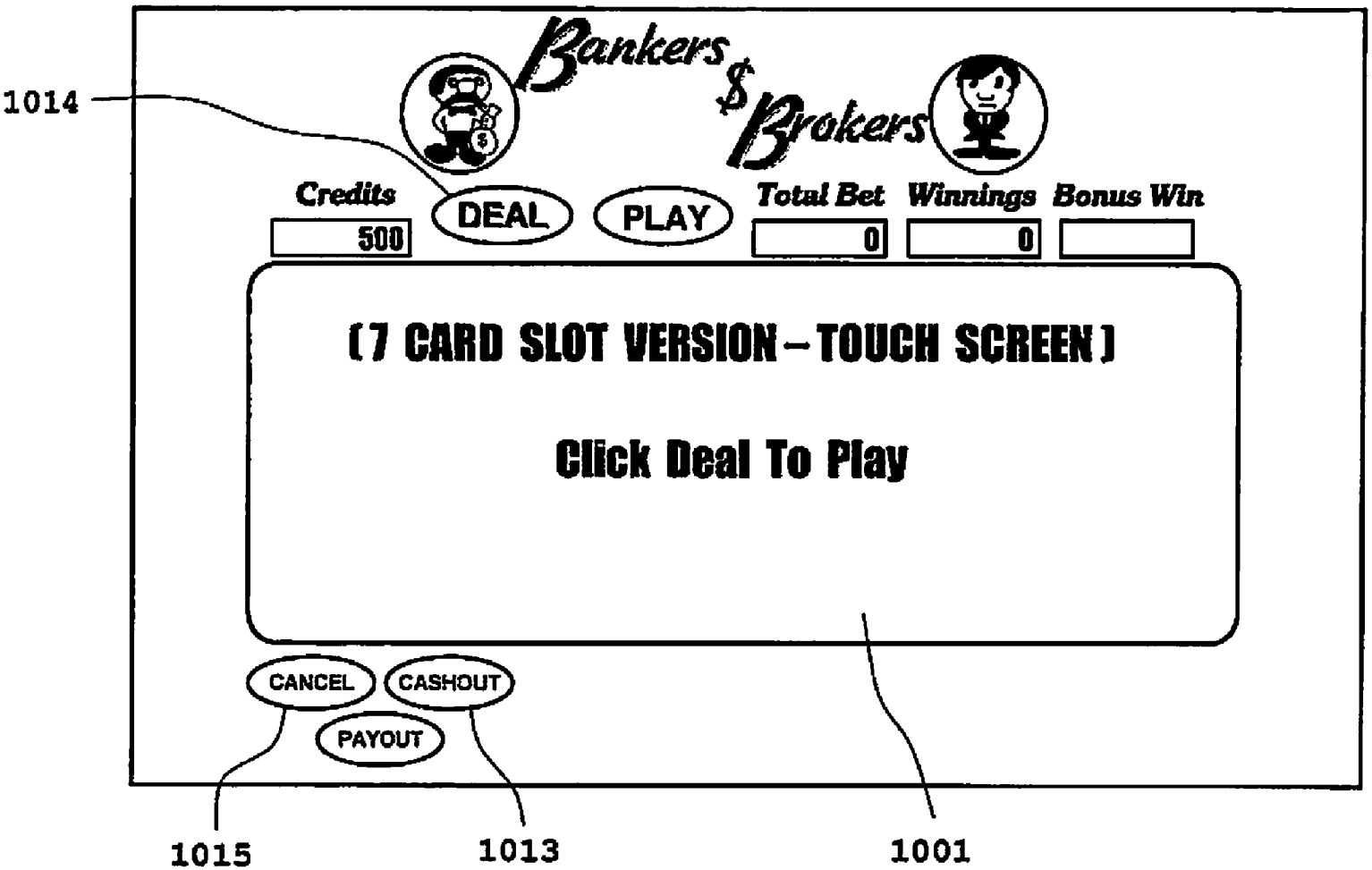
FIGS. 11*a*-11*g* illustrate views of a display screen of an additional embodiment of the present invention.

In an additional embodiment of the inventive game, the inventive game is adapted for being played on a gaming table (table version) by one or more players. The rules of the inventive game according to this embodiment will now be described. The rules are as follows:

1. All bets by the one or more players are made prior to the cards being dealt by the banker or dealer to the one or more players. Each player places an individual bet on at least one of five card positions that the player deems will be dealt a card having a higher value than a card dealt by the banker to himself Each player also has the option of placing a Bonus Bet. The Bonus Bet allows the player to wager on the possibility of attaining a poker hand with his five dealt cards as predefined in a PayOut table (for example, a PayOut table similar to the PayOut table shown in FIG. 11*g* for an embodiment described below).
2. Each player is dealt five cards face down from a standard deck of playing cards.
3. The banker deals himself one card face down from the standard deck of playing cards to a respective dealer position for subsequently comparing its value to the values corresponding to each of the five cards dealt to each player.
4. All the cards are then turned over by the banker one at a time, beginning with the banker's card, to reveal each card's value.
5. After each player's card is turned over, the card(s) for which the player has placed a bet for its corresponding card position is compared to the banker's card. The card with the higher value wins; however, if both cards are of equal value (tie), the player loses half of his bet. This process continues until all of the players' cards that have associated bets have been turned over and compared to the banker's card.
6. After all cards having associated bets have been compared to the banker's card, the Bonus Bets (if any) are then evaluated. The highest ranking five-card poker hand (if any) is determined for each player who has placed a Bonus Bet. For each player who has a poker hand as defined by a PayOut table (for example, a PayOut table similar to the PayOut table shown in FIG. 11*g* for an embodiment described below), that player is awarded a bonus payout in accordance with the PayOut table.

In an additional embodiment of the inventive game which is also adapted for being played on a gaming table (table version) by one or more players, the rules are as follows:

1. All bets by the one or more players are made prior to the cards being dealt by the banker or dealer to the one or more players. Each player places an individual bet on at least one of five card positions that the player deems will be dealt a card having a higher value than a card dealt by the banker to himself. Each player also has the option of placing a Bonus Bet. The Bonus Bet allows the player to wager on the possibility of attaining a better or higher-ranking poker hand with his five dealt cards than five additional cards dealt by the banker to himself. Standard or traditional poker rules are used to determine if the player has attained a higher-ranking poker hand than the banker.
2. Each player is dealt five cards face down from a standard deck of playing cards.
3. The banker deals himself one card face down (comparison card) from the standard deck of playing cards to a respective dealer position for subsequently comparing its value to the values corresponding to each of the five cards dealt to each player. The banker also deals himself five additional cards (poker hand cards) to respective dealer positions for determining if the player has attained a higher-ranking poker hand than the banker, if the player has made a Bonus Bet wager.
4. All the cards are then turned over by the banker one at a time, beginning with the banker's cards, to reveal the comparison card's value and the banker's poker hand (if any).
5. After each player's card is turned over, the card(s) for which the player has placed a bet for its corresponding card position is compared to the banker's card. The card with the higher value wins; however, if both cards are of equal value (tie), the player loses half of his bet. This process continues until all of the players' cards that have associated bets have been turned over and compared to the banker's card.

6. After all cards having associated bets have been compared to the banker's comparison card, the Bonus Bets (if any) are then evaluated. The highest ranking five-card poker hand (if any) is determined for each player who has placed a Bonus Bet and for the banker using the banker's poker hand cards. For each player who has a poker hand which ranks higher than the banker poker hand (if any) using traditional or standard poker rules, is awarded a bonus payout in accordance with a predefined PayOut table.

Even though the last two described embodiments of the inventive game were described with respect to being adapted for play on a gaming table, it is contemplated that these embodiments can also be configured and adapted for play electronically via an electronic gaming device, such as a casino-type gaming machine and a personal computing device, such as a personal computer, PDA, cellular telephone, etc. As such, a set of programmable instructions are executed by at least one processor of the gaming device, where the set of programmable instructions upon being executed enable one to play the inventive game via the gaming device as known in the art and described herein and/or contemplated with respect to other embodiments of the inventive game. These two embodiments can also be configured and adapted for play by a single or multiple players over a network, such as the Internet, by accessing a particular website and initiating play of the inventive game.

Figure 11B:
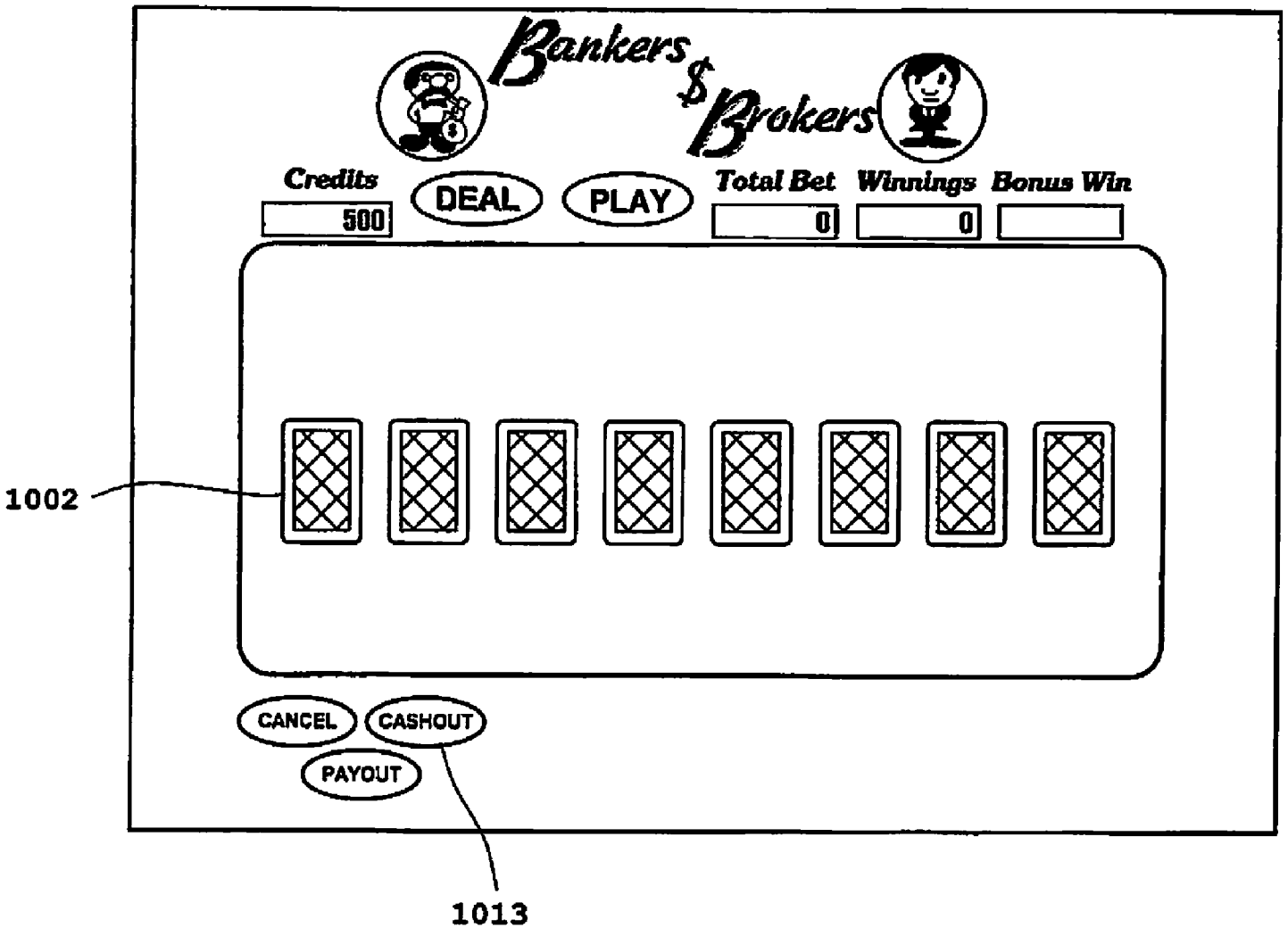
Figure 11C:
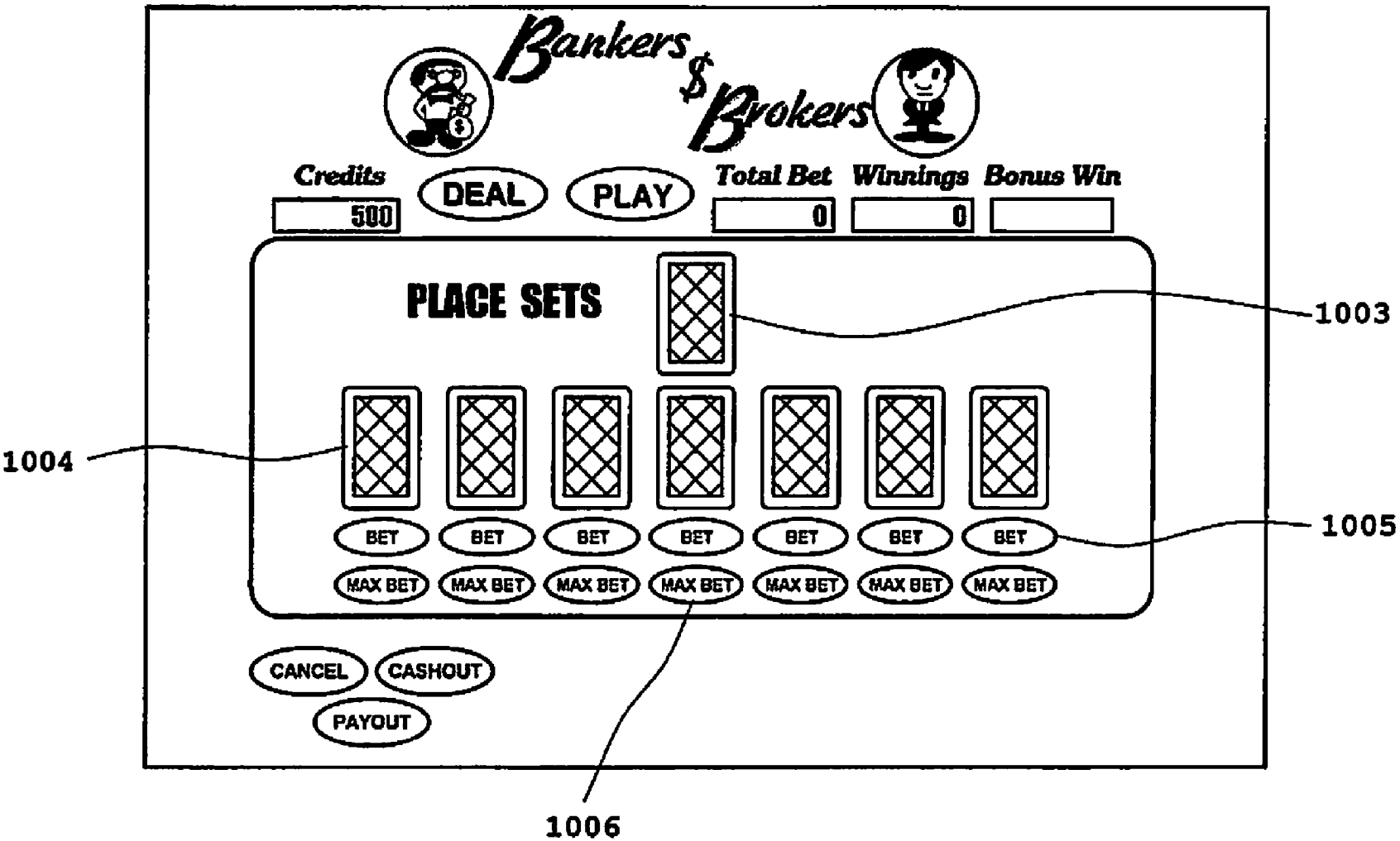
Figure 11D:
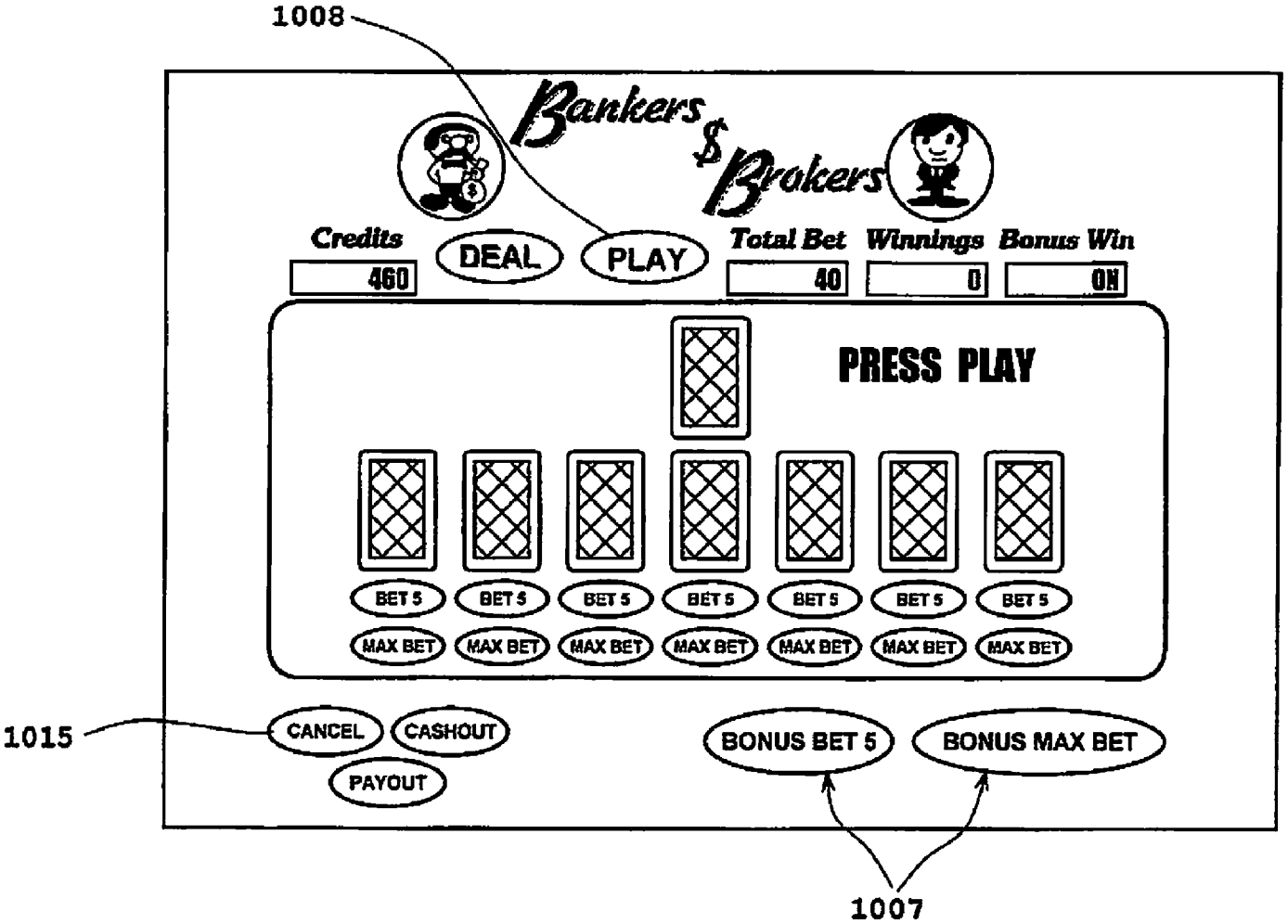
Figure 11E:
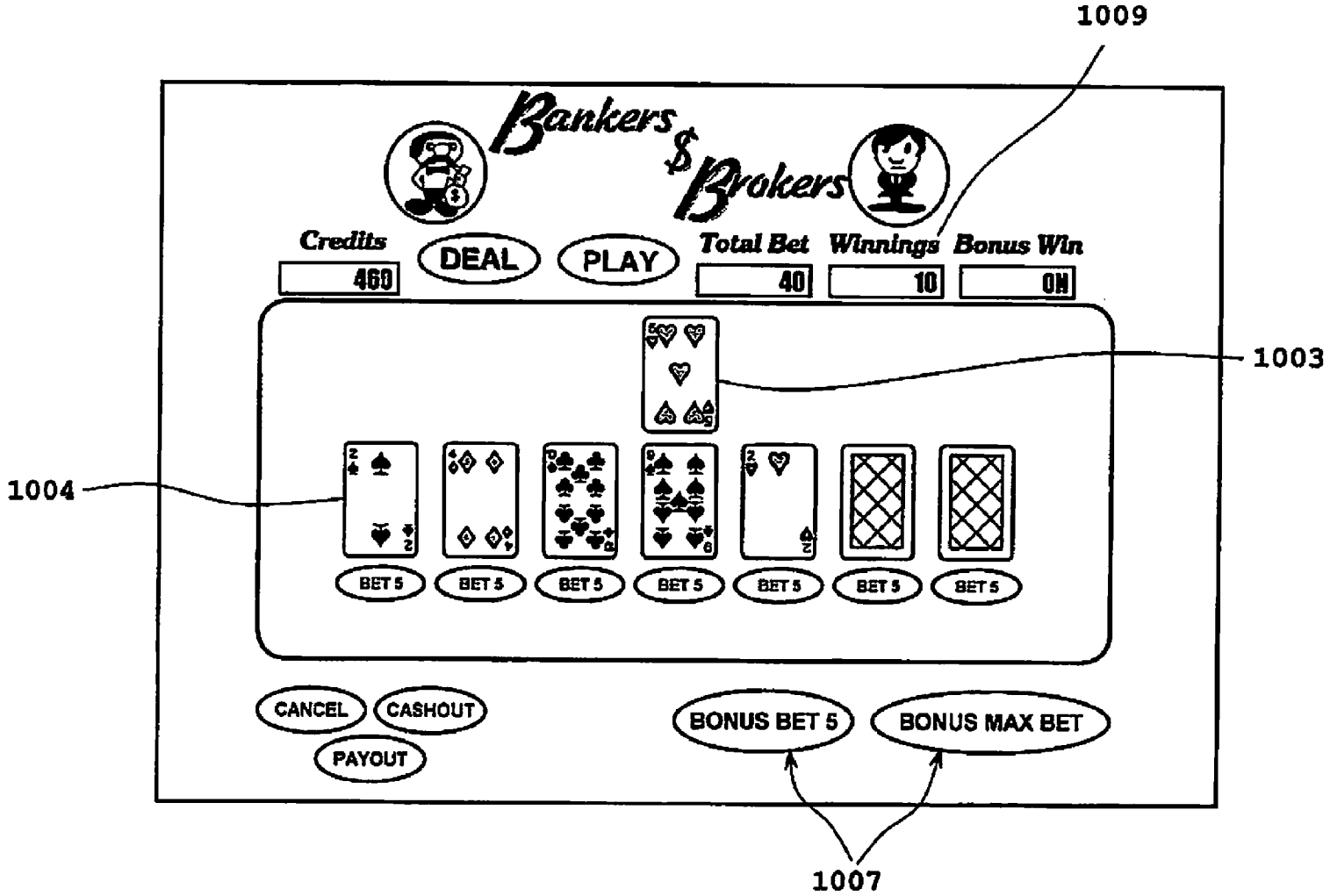
Figure 11F:
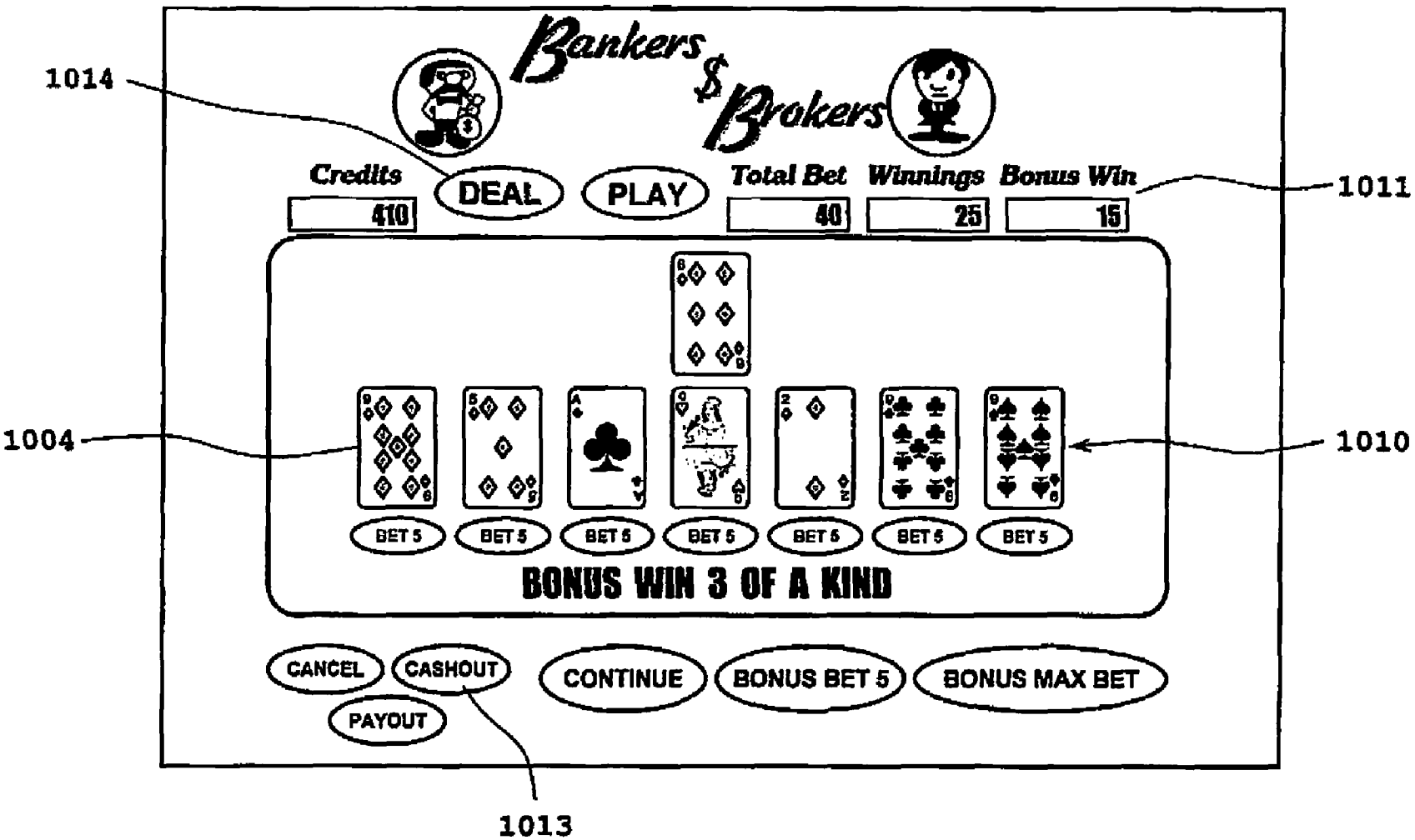
Figure 11G:
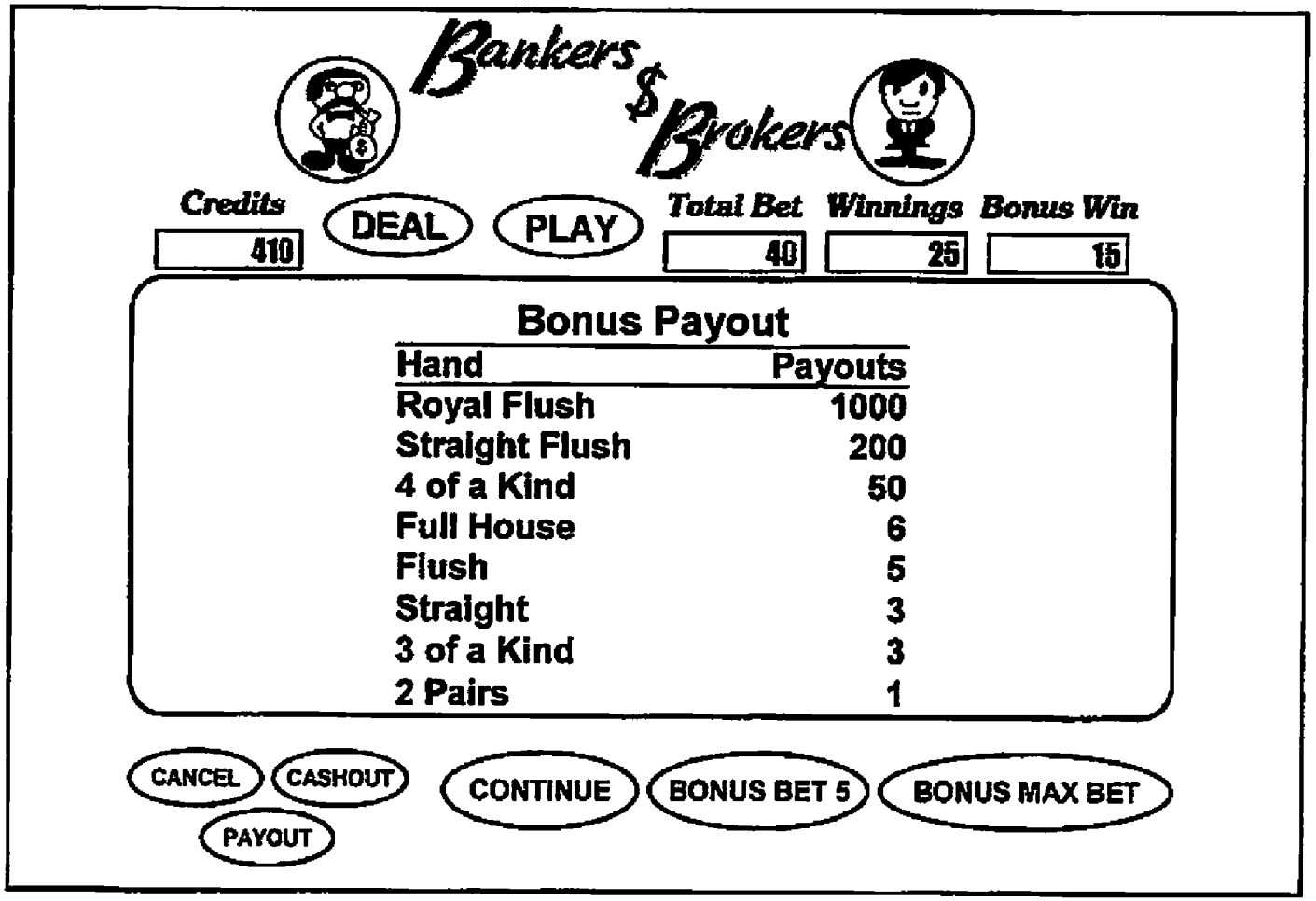

In an additional embodiment of the inventive game in a gaming device as described previously, the game is played as a single player game and as such the rules are slightly modified to enhance game play by only one player. The modified rules are as follows:

1. Upon initiation of game play by selecting Deal 1014 (FIG. 11*a*), a plurality of cards is dealt face down on to position 1001 (FIG. 11*a*).
2. The player selects one card from the plurality of cards dealt 1002 (FIG. 11*b*). This selected card becomes known as the Banker's Card and is removed to position 1003 (FIG. 11*c*) on the screen. The remaining cards dealt 1002 become the Player's Cards 1004 (FIG. 11*c*). All cards on screen up to this point are still face down.
3. Betting now commences. The player places an individual bet on each card the player deems will be of higher value than the Banker's Card 1003. Bets may be placed on one or more of the Player's Cards 1004 at the player's discretion by selecting the Bet button 1005 one or more times or Max Bet button 1006 to immediately bet the maximum allowable amount directly below the card to be bet on. If the player places bets on 5 or more of the Players Cards 1004, an additional Bonus Bet option 1007 (FIG. 11*d*) is made available. The Bonus Bet 1007 allows the player to wager on the possibility of attaining a poker hand as predefined in the PayOut table shown in FIG. 11*g*. All bets already made can be canceled by selecting Cancel 1015. It is contemplated that all betting occurs prior to the cards being dealt.
4. Upon completion all betting, indicated by the player selecting the Play button 1008 in FIG. 11*d*, the cards are turned over one at a time, beginning with the Banker's Card 1003, to reveal each card's value (see FIG. 11*e*). Only the cards that have not been bet on nor selected as the Banker's Card 1003 are left unturned.
5. After each Player's Card 1004 is turned, it is compared to the Banker's Card 1003. The card with the higher value wins, however if both cards are of equal value, the Banker wins. Credits for a player win are applied to Winnings 1009. This process continues until all of the Player's Cards 1004 that have associated bets have been turned over and compared to the Banker's Card 1003.
6. If the player placed a Bonus Bet, it is evaluated now. The highest ranking 5 card poker hand is determined from among the turned over Player's Cards 1004. As shown in FIG. 11*f*, a winning poker hand 1010 as defined by the PayOut chart shown by FIG. 11*g* will be indicated and the appropriate credits applied to the Bonus Win 1011.
7. The player can end further game play by selecting Cash Out 1013 or can proceed to play again by selecting Deal 1014.

In an alternate embodiment, the inventive card game can be played as a secondary game in a gaming device constructed to play a primary game and a secondary game when certain conditions or outcomes are satisfied in the primary game. In other words, the secondary game may or may not be activated dependent upon the outcome achieved in the primary game.

Figure 9:
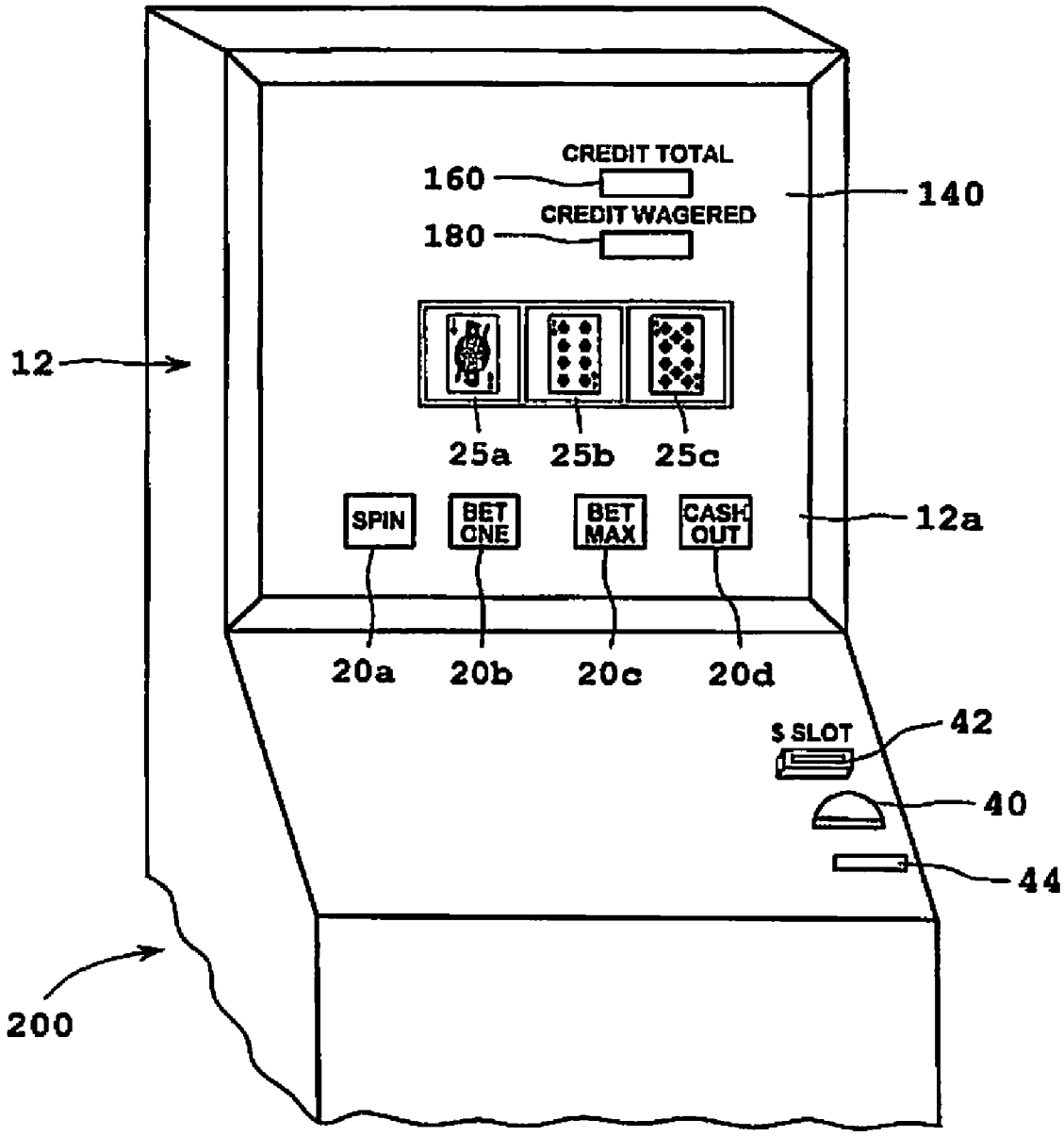
FIG. 9 is a perspective view of the computer video machine of FIG. 2 according to a another embodiment of the present invention.

Referring first to FIG. 9, which is an illustration of an exemplary primary game (i.e., a simulated slot game) having a plurality of possible outcomes (slot combinations) where particular outcomes trigger or activate the secondary card game. It should be appreciated that the primary game could, for example, be any video game currently played in a casino gaming environment. The only restriction on the selection of the primary game is that it should have multiple outcomes from which a certain select subset of those outcomes will trigger the play of the secondary game.

With continued reference to FIG. 9, a display screen 140 illustrates a simulated slot machine as the primary game. The slot machine includes three vertical simulated slot machine reels 25*a*-25*c*. In a typical round of play, there is a winning outcome if the reels 25*a*-25*c* display three of a kind of any game symbol. Further, if reels 25*a* and 25*b* display two of a kind of any game symbol and reel 25*e* displays one of two special symbols (i.e., the "banker" symbol and the "player" symbol), a winning-outcome occurs which also activates the secondary card game.

While the primary slot game is not the focus of the present invention, it is described in some detail to more fully illustrate the dual game embodiment and how the inventive card game may be activated.

With reference to the primary slot game, in each round of play, in response to a player pressing the spin button 20*a*, each slot machine reel 25*a*-25*c* displays one game symbol selected randomly from an associated look-up table stored in the microprocessor-based circuit's ROM. In FIG. 9, reel 25*a* illustrates a King of diamonds, reel 25*b* illustrates the eight of clubs, and reel 25*c* illustrates the ten of clubs. Each symbol is randomly selected from the look-up table 34 holds integer values in a prescribed range, where each integer value corresponds, for example, to each of the playing cards in a typical 52 card deck. Assigned to each integer value RN is a game element selected from a group of 13 pre-determined game symbols representing standard playing card symbols (e.g., Ace, King, Queen and so on). In addition, integer values 14 and 15 represent the two special symbols, i.e., "banker" and "player". In alternate embodiments, the pre-determined game symbols may resemble typical slot machine objects such as "bars", "oranges", "cherries" etc. Similar to that described above, display 140 includes a bet one credit button 20*b*, and a max wager button 20*c*.

Once the player has completed his wagering for the current round, the player is prompted to press the "Spin" button 20*a*, or alternatively pull a conventional pull handle. Once this is done, the microprocessor-based circuit conditions the display screen 140 to simulate the spinning wheels of a slot machine. The spinning wheel simulation appears in each of the three reels 25*a*, 25*b* and 25*c* of the main game. Each reel eventually comes to a stop and symbols are displayed in each of the reels. Certain symbol combinations have been pre-selected as winning combinations and are shown to the player in the pay table. If the player achieves a winning combination of symbols then the player wins. Any suitable pay table can be used. An example of a representative pay table is shown in Table 1.

With regard to Table I, the letters A, B, C, D, E, F, G, H, I, J, K, L and M represent suitable symbols that can be used on the reels 25*a*-25*c*. For example, in the preferred embodiment, the symbols associated with a standard deck of cards are used, as illustrated in FIG. 1. For example, the letter A could represent an "Ace" and the letter "B" could represent a "King"

TABLE 1

| | WINNING COMBINATIONS | | | PAYOUT |
|---|---|---|---|---|
| Row 1 | A | A | A | 2000 |
| Row 2 | B | B | B | 1750 |
| Row 3 | C | C | C | 1500 |
| Row 4 | D | D | D | 1250 |
| Row 5 | E | E | E | 1000 |
| Row 6 | F | F | F | 750 |
| Row 7 | G | G | G | 500 |
| Row 8 | H | H | H | 250 |
| Row 9 | I | I | I | 150 |
| Row 10 | J | J | J | 75 |
| Row 11 | K | K | K | 50 |
| Row 12 | L | L | L | 20 |
| Row 13 | M | M | M | 10 |
| Row 14 | XX | XX | "Player" | Activates secondary game |
| Row 15 | XX | XX | "Banker" | Activates secondary game |

and so on. Alternatively, the letters could represent a group of symbols such as the fruit symbols, which are well known, or a common theme could be used. With reference to the last two rows of Table I above, the letters XX represent any of the symbols A-M with the understanding that the symbols represented by XX must be identical in each of the first two reels 25*a*, 25*b* of rows 14 and 15 for a payout to occur.

If a winning combination of game symbols occurs, as described in Table I, the microprocessor-based circuit determines whether the secondary card game is activated. In the present example, activation of the secondary game occurs only for those winning combinations defined by rows 14 and 15 of Table I. Otherwise, those winning combinations defined by rows 1-13 will pay out according to the table and will not activate the secondary game. In this case, the microprocessor-based circuit calculates the credits won from the payout Table I. The microprocessor-based circuit then conditions the screen to show the total credits won and advances the credit total accordingly for pay outs from payout Table I.

In the case where the winning combination is defined by either row 14 or 15 of Table 1, the secondary game is activated. The winning combinations defined by rows 14 and 15 uniquely determine how the secondary game will be played. As such, the winning combinations defined by rows 14 and 15 will be discussed separately.

Referring first to the winning combination defined by row 14 of Table I in which the first two reels 25*a*, 25*b* define any matching pair and the third reel 25*c* shows the "player" symbol. The "Player" symbol represents one of the two trigger symbols for activating the secondary game. The other trigger symbol is the "Dealer" symbol. The particular steps for playing the secondary game are discussed further below.

Referring now to the winning combination defined by row 15 in which in which the first two reels 25*a*, 25*b* define any matching pair and the third reel 25*c* shows the "Banker" symbol. The "Banker" symbol represents a second trigger symbol for activating the secondary game. In this case, in the secondary card game, the player plays the role of the "dealer". As the dealer, the player has an opportunity to win against each player position in the secondary game. In the present example, the banker position may win up to seven times, once for each of player positions P1-P7.

Figure 10:
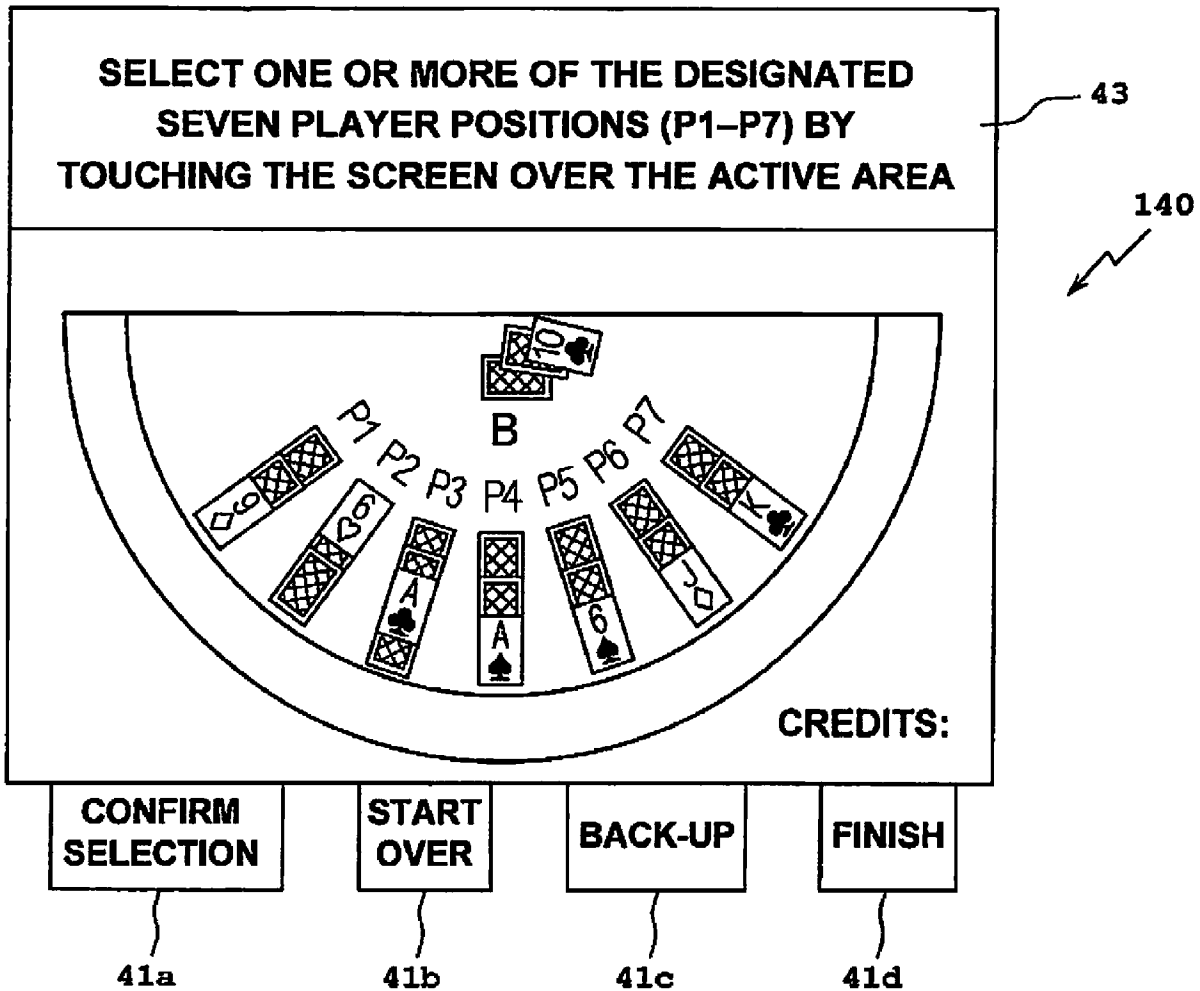
FIG. 10 is a perspective view of the computer video machine of FIG. 2 which illustrates an exemplary round of play in which the secondary game is activated.

FIG. 10 is an illustration of an exemplary round of play in which the secondary game is activated from row 15 of the pay table of Table 1. FIG. 10 illustrates the state of the game subsequent to six cards being dealt to each player and the banker and a bottom card being turned over at each of the respective eight table positions. In the example, the banker turns over a ten of clubs, player P1 turns over a nine of diamonds, player P2 turns over a six of hearts, player P3 turns over a four of clubs, player P4 turns over an ace of spades, player P5 turns over a six of diamonds, player P6 turns over a jack of diamonds and player P7 turns over a king of spades. The banker's turned over card, i.e., ten of clubs, is compared against each player's card in accordance with the rules of the game. The result is shown in Table II.

As shown in Table II, the rank of the banker's dealt card is sufficient to obtain a win over only players P1, P2, P3 and P5. In this example, the wagered amount won by the player in the

TABLE II

| Banker's Card | Player | Player's Card | Result |
|---|---|---|---|
| 10 of Clubs | P1 | 9 of Diamonds | Banker Wins |
| 10 of Clubs | P2 | 6 of Hearts | Banker Wins |
| 10 of Clubs | P3 | 4 of Clubs | Banker Wins |
| 10 of Clubs | P4 | Ace of Spades | Banker Loses |
| 10 of Clubs | P5 | 6 of Diamonds | Banker Wins |
| 10 of Clubs | P6 | Jack of Diamonds | Banker Loses |
| 10 of Clubs | P7 | King of Spades | Banker Loses |

primary slots game is multiplied by four, i.e., the number of wins in the secondary game. As shown, the number of wins in the secondary game becomes the multiplier of the wagered amount in the primary game winnings corresponds to the number of wins accrued in the secondary game. Upon determining a payout amount and appropriately crediting the player, the current round of the secondary game is considered complete. As described above, at the end of a round of play of the combined primary/secondary games, the player can cash-out or build credits.

It should be appreciated that alternative methods may be used in the primary game to activate the secondary card game. It should be appreciated that the rules of the secondary card game may be modified when it is incorporated as a secondary game.

It is to be understood that the present invention is not limited to the embodiments described herein, but in accordance with the doctrine of equivalents, encompasses any and all embodiments within the scope of the claims.

Additional embodiments are described below in the context of playing the inventive card game adapted for machine play on a video machine in a casino gaming environment for ease of explanation, however, it should be appreciated that the following embodiments are equally applicable to the table versions described above.

In one embodiment, it is contemplated that once a predetermined number of cards (i.e., pot) is dealt to each elected player position and the dealer, each card from the respective pots will be played in a separate round. As an illustration, consider that a player elects to play a single position (e.g., P3), the player and the dealer will each be dealt a single pot (e.g., six cards). The number of cards dealt may be any number of cards. The player makes a wager on the single elected position (e.g., P3). Once a wager has been made, cards are dealt to the player position (i.e., the player's pot) and a single card, preferably a top card, is upturned from the player's pot.

The upturned card is compared with an upturned card from the dealer's pot. The upturned cards are compared as described in accordance with previous embodiments to determine a player's winning or losing status. At this point, a round of play is concluded and the respective upturned cards are discarded.

In a previously described embodiment, at the conclusion of a round of play, any remaining cards in the player's and dealer's "pot" are discarded. By contrast, in the present embodiment, at the conclusion of a round of play, only the single upturned card from each player position (e.g., P3) and dealer position is discarded. That is, the remaining cards from the respective "pots" are retained for use in future rounds. Specifically,-subsequent to concluding a round of play (i.e., discarding the upturned cards from the respective "pots"), a player makes a new wager to initiate a next round of play. Once the new wager is made, a next card from the respective player positions and dealer position is upturned and compared in the manner described above. This constitutes a next round of play. This process is again repeated for each card from the respective player's and dealer's pots. For example, in the case where a pot constitutes six cards, six individual rounds of play will be conducted wherein in each round a separate wager is made to determine a winning or losing status for the player. It is further noted that in each round, the card to be played (upturned) may be the current top card, bottom card, or any intervening card from the pot.

The present embodiment affords advantages, for both the electronic versions of the game and especially for the live table version, in that a greater number of rounds of play may be conducted over a prescribed time interval. That is, the frequency of dealing, discarding, and re-shuffling is significantly reduced.

In another embodiment, it is contemplated to allow the player/dealer to randomly select any one of his dealt cards to be turned over.

In another embodiment, it is further contemplated to allow the player/dealer to discard his upturned card and turn over a next card when the upturned card's rank is above or below a certain rank value. For example, if the upturned card is a five or below, the card may be discarded and the next card in the pot may be upturned. This practice can be continued for each upturned card or may be made applicable for one substitution.

In another embodiment, it is further contemplated to allow a player/dealer to turn over one or more additional cards if a presently upturned card equals a predetermined rank. That is, a player may turn over the next card in the pot only if the upturned card is a ten or an eight, for example.

It is also contemplated to allow a player/dealer to discard one or more dealt cards before/after upturning the dealt cards to receive replacements cards in their place. In this embodiment, a player may, without looking at his pot of cards, discard, none, one, or more cards from his pot and receive substitute cards.

It is yet further contemplated to allow the player/dealer to turn over a number of cards corresponding to the number of positions wagered on. In other words, if a player elects to play three positions, the player may elect to discard a first upturned card, a second upturned card, and a third upturned card corresponding to the three hands played. In this case, the player is given four opportunities to upturn a card having a favorable rank.

It is to be understood that each of the aforementioned alternatives are not to be construed as limiting, but rather as being exemplary of alternative methods for revealing a players/dealers upturned card. As such, variations on the above methods and other methods not explicitly recited herein are within the scope of the present invention.

While the invention has been illustrated with respect to several specific embodiments thereof, these embodiments should be considered as illustrative rather than limiting. Various modifications and additions may be made and will be apparent to those skilled in the art.

What is claimed is:

1. A computer device comprising:

a processor for executing a set of programmable instructions for playing a card game, said card game including the steps of:

identifying each of said at least one player position and said at least one dealer position to a player;

accepting a wager corresponding to at least one of said at least one player position from the player;

providing the player an option to place an additional wager on whether at least one of a plurality of predetermined combinations will be formed with said at least one card dealt to each of said wagered and non-wagered player positions;

dealing at least one card to each of said wagered and non-wagered player positions and said at least one dealer position from at least one deck of cards;

comparing an upturned card at said dealer position from among said at least one card dealt to said at least one dealer position with an upturned card from among said at least one card dealt to at least one wagered position;

determining a winning or loss status for the at least one wagered position, wherein a winning status is determined for the at least one wagered position when said upturned card dealt to said at least one wagered position has a higher ranking than said upturned card at said at least one dealer position; and resolving whether at least one of the plurality of predetermined combinations were formed with said at least one card dealt to each of said wagered and non-wagered player positions if the player placed the additional wager.

2. The computer device of claim 1, wherein the step of comparing an upturned card at said at least one dealer position with an upturned card from each of said at least one wagered position entails the processor performing the step of comparing a ranking value of said upturned card from each of the at least one wagered position with a ranking value of said upturned card at said at least one dealer position.

3. The computer device of claim 2, wherein the step of determining the player's winning or loss status entails the processor performing the step of determining if said ranking value from each of said at least one wagered position is greater than or less than said ranking value, respectively, of said upturned card at said at least one dealer position.

4. The computer device of claim 1, wherein the at least one of the plurality of predetermined combinations is selected from the group consisting of poker hands.

5. The computer device of claim 1, wherein the step of dealing entails the processor performing the step of dealing six cards, and wherein each card of the six cards is dealt to a respective dealer position of said at least one dealer position.

6. The computer device of claim 5, wherein five cards of said six cards form a five-card dealer poker hand, and the step of resolving whether at least one of the plurality of predetermined combinations were formed with said at least one card dealt to each of said wagered and non-wagered player positions if the player placed the additional wager entails the processor performing the step of determining, if at least one of the plurality of predetermined conditions were formed, whether the at least one formed predetermined condition of said plurality of predetermined conditions has a higher ranking than a ranking, if any, of a set of cards corresponding to the dealer.

7. The computer device of claim 1, wherein the computer device is selected from the group consisting of a personal computing device, such as a PDA and cellular telephone, and a casino-type gaming machine.

8. A computer device comprising:

a processor for executing a set of programmable instructions for playing a card game, said card game including the steps of:

identifying at least one player position and at least one dealer position to a player;

accepting a wager corresponding to at least one of said at least one player position from the player;

accepting another wager from the player on whether said at least one card dealt to each of said wagered and non-wagered player positions will form at least one of a plurality of predetermined combinations having a higher ranking than at least one of a plurality of predetermined combinations, if any, formed by one or more of the at least one card dealt to said at least one dealer position;

dealing at least one card to each of said wagered and non-wagered player positions and said at least one dealer position from at least one deck of cards;

comparing an upturned card at said dealer position from among said at least one card dealt to said at least one dealer position with an upturned card from among said at least one card dealt to at least one wagered position;

determining a winning or loss status for the at least one wagered position, wherein a winning status is determined for the at least one wagered position when said upturned card dealt to said at least one wagered position has a higher ranking than said upturned card at said at least one dealer position; and resolving whether at least one of the plurality of predetermined combinations were formed with said at least one card dealt to each of said wagered and non-wagered player positions.

9. The computer device of claim 8, wherein the at least one of the plurality of predetermined combinations is selected from the group consisting of poker hands.

10. The computer device of claim 8, wherein the processor performs the step of determining an award won by the player for forming at least one of the plurality of predetermined combinations having a higher ranking than said at least one of the plurality of predetermined combinations, if any, formed by one or more of the at least one card dealt to said at least one dealer position, if player placed said another wager.

11. The computer device of claim 8, wherein the computer device is selected from the group consisting of a personal computing device, such as a PDA and cellular telephone, and a casino-type gaming machine.

12. A computer device comprising:

a processor for executing a set of programmable instructions for playing a card game;

a display in operative communication with said processor; and input means in operative communication with said processor for receiving at least one input from a player during play of the card game;

wherein the card game entails the processor performing the steps of:

identifying at least one player position and at least one dealer position to a player;

accepting a wager corresponding to at least one of said at least one player position from the player;

providing the player an option to place an additional wager on whether at least one of a plurality of predetermined combinations will be formed with said at least one card dealt to each of said wagered and non-wagered player positions;

dealing at least one card to each of said wagered and non-wagered player positions and said at least one dealer position from at least one deck of cards;

comparing an upturned card at said dealer position from among said at least one card dealt to said at least one dealer position with an upturned card from among said at least one card dealt to at least one wagered position;

determining a winning or loss status for the at least one wagered position, wherein a winning status is determined for the at least one wagered position when said upturned card dealt to said at least one wagered position has a higher ranking than said upturned card at said at least one dealer position; and resolving whether at least one of the plurality of predetermined combinations were formed with said at least one card dealt to each of said wagered and non-wagered player positions if the player placed the additional wager.

13. The computer device of claim 12, wherein the step of comparing an upturned card at said at least one dealer position with an upturned card from each of said at least one wagered position entails the processor performing the step of comparing a ranking value of said upturned card from each of the at least one wagered position with a ranking value of said upturned card at said at least one dealer position.

14. The computer device of claim 12, wherein the step of determining the player's winning or loss status entails the processor performing the step of determining if said ranking value from each of said at least one wagered position is greater than or less than said ranking value, respectively, of said upturned card at said at least one dealer position.

15. The computer device of claim 12, wherein the at least one of the plurality of predetermined combinations is selected from the group consisting of poker hands.

16. The computer device of claim 12, wherein the step of dealing entails the processor performing the step of dealing six cards, and wherein each card of the six cards is dealt to a respective dealer position of said at least one dealer position.

17. The computer device of claim 16, wherein five cards of said six cards form a five-card dealer poker hand, and the step of resolving whether at least one of the plurality of predetermined combinations were formed with said at least one card dealt to each of said wagered and non-wagered player positions if the player placed the additional wager entails the processor performing the step of determining, if at least one of the plurality of predetermined conditions were formed, whether the at least one formed predetermined condition of said plurality of predetermined conditions has a higher ranking than a ranking, if any, of a set of cards corresponding to the dealer.

18. The computer device of claim 12, wherein the computer device is selected from the group consisting of a personal computing device, such as a PDA and cellular telephone, and a casino-type gaming machine.

19. A computer device comprising:

a processor for executing a set of programmable instructions for playing a card game;

a display in operative communication with said processor; and input means in operative communication with said processor for receiving at least one input from a player during play of the card game;

wherein the card game entails the processor performing the steps of:

identifying at least one player position and at least one dealer position to a player;

accepting a wager corresponding to at least one of said at least one player position from the player;

accepting another wager from the player on whether said at least one card dealt to each of said wagered and non-wagered player positions will form at least one of a plurality of predetermined combinations having a higher ranking than at least one of a plurality of predetermined combinations, if any, formed by one or more of the at least one card dealt to said at least one dealer position;

dealing at least one card to each of said wagered and non-wagered player positions and said at least one dealer position from at least one deck of cards;

comparing an upturned card at said dealer position from among said at least one card dealt to said at least one dealer position with an upturned card from among said at least one card dealt to at least one wagered position;

determining a winning or loss status for the at least one wagered position, wherein a winning status is determined for the at least one wagered position when said upturned card dealt to said at least one wagered position has a higher ranking than said upturned card at said at least one dealer position; and resolving whether at least one of the plurality of predetermined combinations were formed with said at least one card dealt to each of said wagered and non-wagered player positions.

20. The computer device of claim 19, wherein the at least one of the plurality of predetermined combinations is selected from the group consisting of poker hands.

21. The computer device of claim 19, wherein the processor performs the step of determining an award won by the player for forming at least one of the plurality of predetermined combinations having a higher ranking than said at least one of the plurality of predetermined combinations, if any, formed by one or more of the at least one card dealt to said at least one dealer position, if player placed said another wager.

22. The computer device of claim 19, wherein the computer device is selected from the group consisting of a personal computing device, such as a PDA and cellular telephone, and a casino-type gaming machine.

* * * * *